US011554060B2

(12) United States Patent
Gardner et al.

(10) Patent No.: US 11,554,060 B2
(45) Date of Patent: Jan. 17, 2023

(54) WALKER ATTACHMENT FOR WHEELCHAIRS

(71) Applicant: Gardner Medical, LLC, Shelbyville, KY (US)

(72) Inventors: Kenneth A. Gardner, Shelbyville, KY (US); Craig Hidalgo, Langhorne, PA (US); David G. Reed, Langhorne, PA (US)

(73) Assignee: GARDNER MEDICAL, LLC, Shelbyville, KY (US)

( * ) Notice: Subject to any disclaimer, the term of this patent is extended or adjusted under 35 U.S.C. 154(b) by 286 days.

(21) Appl. No.: 16/942,847

(22) Filed: Jul. 30, 2020

(65) Prior Publication Data

US 2020/0352805 A1 Nov. 12, 2020

Related U.S. Application Data

(63) Continuation-in-part of application No. 15/905,917, filed on Feb. 27, 2018, now Pat. No. 10,765,587.

(60) Provisional application No. 62/884,322, filed on Aug. 8, 2019, provisional application No. 62/467,307, filed on Mar. 6, 2017.

(51) Int. Cl.
*A61G 5/14* (2006.01)
*A61H 3/04* (2006.01)

(52) U.S. Cl.
CPC ..... *A61G 5/14* (2013.01); *A61H 3/04* (2013.01); *A61G 2200/34* (2013.01); *A61H 2203/0406* (2013.01)

(58) Field of Classification Search
CPC ..... A61H 3/04
See application file for complete search history.

(56) References Cited

U.S. PATENT DOCUMENTS 2,556,121 A * 6/1951 Thomas ..... A61G 5/10 482/68
2,596,055 A * 5/1952 Thomas ..... A61G 5/14 482/68

(Continued)

FOREIGN PATENT DOCUMENTS

GB 2105268 A 3/1983
JP 2014030692 A 2/2014
WO 2016010863 A1 1/2016

OTHER PUBLICATIONS

English Machine translation of JP2014030692A.

*Primary Examiner* — Jacob D Knutson
(74) *Attorney, Agent, or Firm* — Dickinson Wright PLLC; Nicholas P. Coleman

(57) ABSTRACT

A walker adapted for attachment to a wheelchair may be used to assist a user with walking while retaining the wheelchair in close proximity behind the user for use when the user needs to sit. The walker may be removably attached to the frame of the wheelchair for easy exchange of use from one wheelchair to another. A pivotable, removably attachable gate between two lateral frame members may allow for the walker to be manipulated from a walking position to a stored position. The gate may include an extendable width to allow for use with wheelchairs of different widths. A frame of the walker may be extendably attached to the wheelchair, thereby allowing the user to extend and retract the walker between the walking position and the stored position.

20 Claims, 23 Drawing Sheets

(56) References Cited

U.S. PATENT DOCUMENTS

| | | | | |
|---|---|---|---|---|
| 2,958,067 | A | 10/1960 | Hardy | |
| 3,584,890 | A | 6/1971 | Presty | |
| 3,719,390 | A * | 3/1973 | Haney | A61G 5/1054 297/42 |
| 3,999,778 | A | 12/1976 | Markiel | |
| 4,342,465 | A | 8/1982 | Stillings | |
| 4,431,076 | A | 2/1984 | Simpson | |
| 4,830,035 | A | 5/1989 | Liu | |
| 4,934,725 | A | 6/1990 | Owens | |
| 4,948,156 | A * | 8/1990 | Fortner | A61G 5/14 297/DIG. 10 |
| 5,005,599 | A * | 4/1991 | Cunningham | A61H 3/00 135/72 |
| 5,277,438 | A * | 1/1994 | Chuang | A61H 3/04 280/42 |
| 5,419,571 | A | 5/1995 | Vaughan | |
| 5,443,304 | A * | 8/1995 | Fochs | A61H 3/04 D12/128 |
| 5,445,174 | A | 8/1995 | Cunningham | |
| 7,377,285 | B2 | 5/2008 | Karasin et al. | |
| 7,481,445 | B1 | 1/2009 | Danziger | |
| 7,500,689 | B2 | 3/2009 | Pasternak et al. | |
| 7,651,649 | B2 | 1/2010 | Obitts et al. | |
| 7,703,465 | B2 | 4/2010 | Diamond | |
| 8,998,244 | B2 | 4/2015 | Purdue | |
| 9,351,901 | B1 | 5/2016 | Petsch | |
| 2002/0140196 | A1* | 10/2002 | Crouch | A61H 3/04 280/87.051 |
| 2011/0006494 | A1 | 1/2011 | Walker | |
| 2016/0022517 | A1 | 1/2016 | Frangos et al. | |
| 2016/0184167 | A1 | 6/2016 | Naucke | |
| 2018/0104133 | A1* | 4/2018 | Chen | A61H 3/008 |

* cited by examiner

WALKER ATTACHMENT FOR WHEELCHAIRS

This application claims priority to U.S. PROVISIONAL Application Ser. No. 62/884,322, filed Aug. 8, 2019, as well as U.S. NON-PROVISIONAL Application Ser. No. 15/905,917, filed Feb. 27, 2018, which claims priority to U.S. PROVISIONAL Application Ser. No. 62/467,307, filed Mar. 6, 2017, the disclosures of which are all hereby incorporated by reference in their entireties.

TECHNICAL FIELD

This invention concerns a walker attachment for wheelchairs. More specifically it is a device that can be attached to any manually operated wheelchair, either for short-term or long-term use and once attached provides a walker function that can be used as needed.

BACKGROUND OF THE INVENTION

Wheelchairs are mobility devices that are used primarily by two groups of individuals. One group includes long-term patients who are chronically weak or ill and the other are short-term patients who are in rehabilitation programs such as after a trauma or surgery. Many patients who are long-term wheelchair users still maintain the ability to walk short distances unsupervised. They however, require the use of a walker for such ambulation. Usually the distances they can walk before needing to sit and rest is often limited. Long-term care facilities lack the staffing to supervise such brief episodes of walker-assisted ambulation so most residents are relegated to spending almost all of their time in a wheelchair. This puts patients at higher risk for dependent edema, pressure ulcers, and thrombophlebitis (blood clots).

The other primary group of wheelchair users includes patients who are non-ambulatory for short periods such as when recovering from trauma or a major surgery such as hip or knee replacement. Many of these patients also need a wheelchair intermittently, in between walker use.

Traditionally, in order for a wheelchair user to transition to use of a walker, a separate walker device is needed. This normally requires participation of a second assistant other than the wheelchair user, such as a nurse, physical therapist, family member, or other medical assistant.

Accordingly, a need has been identified for a device that would allow the wheelchair user to transition to a walker that may not require assistance from a third person.

SUMMARY OF THE INVENTION

In one embodiment, the invention generally relates to a device adapted for connection to a wheelchair comprising a frame comprising a first lateral frame member and a second lateral frame member, each of the first lateral frame member and the second lateral frame member comprising an extension portion and a walker portion. When the frame is connected to the wheelchair, each extension portion of the frame is elongated in a direction from an anterior position to a posterior position with respect to the wheelchair, and each extension portion comprises a clamp assembly adapted for releasably attaching to the wheelchair, each of said clamp assemblies adapted to slidably move with respect to a remainder of the frame such that the remainder of the frame may be moved between the anterior position and the posterior position. The frame comprises a gate, said gate being pivotable between a deployed position in which the gate spans between and connects the first lateral frame member to the second lateral frame member, and a stowed position in which the gate does not connect the first lateral frame member to the second lateral frame member.

In one aspect, the gate may be parallel to the direction from the anterior position to the posterior position in the stowed position. In another aspect, the gate may be perpendicular to the direction from the anterior position to the posterior position in the deployed position.

In the deployed position, the gate may be adapted to connect the first lateral frame member to the second lateral frame member at a plurality of different widths therebetween.

In another aspect, the gate may comprise a first gate member being part of the first lateral frame member and a second gate member being part of the second lateral frame member. Each of the first gate member and the second gate member may be parallel to the direction from the anterior position to the posterior position in the stowed position, and the first gate member may connect to the second gate member in the deployed position. A latch may be provided, said latch being adapted to connect the first gate member to the second gate member. In a further aspect, the first gate member may include a receiver for receiving an insertion portion of the second gate member.

At least one of the extension portions may comprise a grip adapted for a user of the wheelchair to grasp and move the remainder of the frame from the posterior position to the anterior position.

The clamp assembly may include at least one clamp adjustably mounted to a clamp mount, said adjustably mounted clamp adapted to engage wheelchairs of different sizes. For example, the at least one clamp may be adapted to be mounted at different positions on the clamp mount to accommodate wheelchairs of different sizes. In one aspect, the clamp assembly may be adapted to slide on an extension rod included in the extension portion.

In a further aspect, the gate may include at least one releasable lock adapted to fix the gate in each of the stowed position and the deployed position. The releasable lock may include a pin or other biasing member adapted to engage one of a plurality of apertures, each aperture corresponding to one of the stowed position or the deployed position.

In another aspect, the walker portion may comprise a handle attached to a telescoping upright rod, said handle adapted for movement between a retracted position and an extended position and adapted for gripping by a hand of a user of the wheelchair. At least one locking connector may be provided, said locking connector being adapted to alternately fix the telescoping upright rod in each of the retracted position and the extended position. The device may further include at least one actuator adapted to release the locking connector, thereby allowing for movement of the telescoping upright rod between the extended position and the retracted position, said actuator adjacent the handle and adapted for actuation by the user while the user is gripping the handle with the same hand that grips the handle.

The locking connector may comprise a spring pin, and the device may further include a releasing member adapted for engaging the spring pin, said releasing member connected to the actuator by a retractable rod. The releasing member may comprise a cam, and the retractable rod may be adapted to cause the cam to rotate about an axis, thereby retracting the spring pin and releasing the telescoping upright rod to move between the extended position and the retracted position. The retractable rod may be connected to the actuator by an anchor.

In a further aspect, a releasable connector may be adapted to releasably connect the extension portion from the walker portion. The releasable connector may comprise a locking pin that is adapted to lock in place within an aperture that passes through a portion of each of the extension portion and the walker portion of the frame.

DETAILED DESCRIPTION OF THE INVENTION

The description provided below and in regard to the figures applies to all embodiments unless noted otherwise, and features common to each embodiment are similarly shown and numbered.

Figure 1:
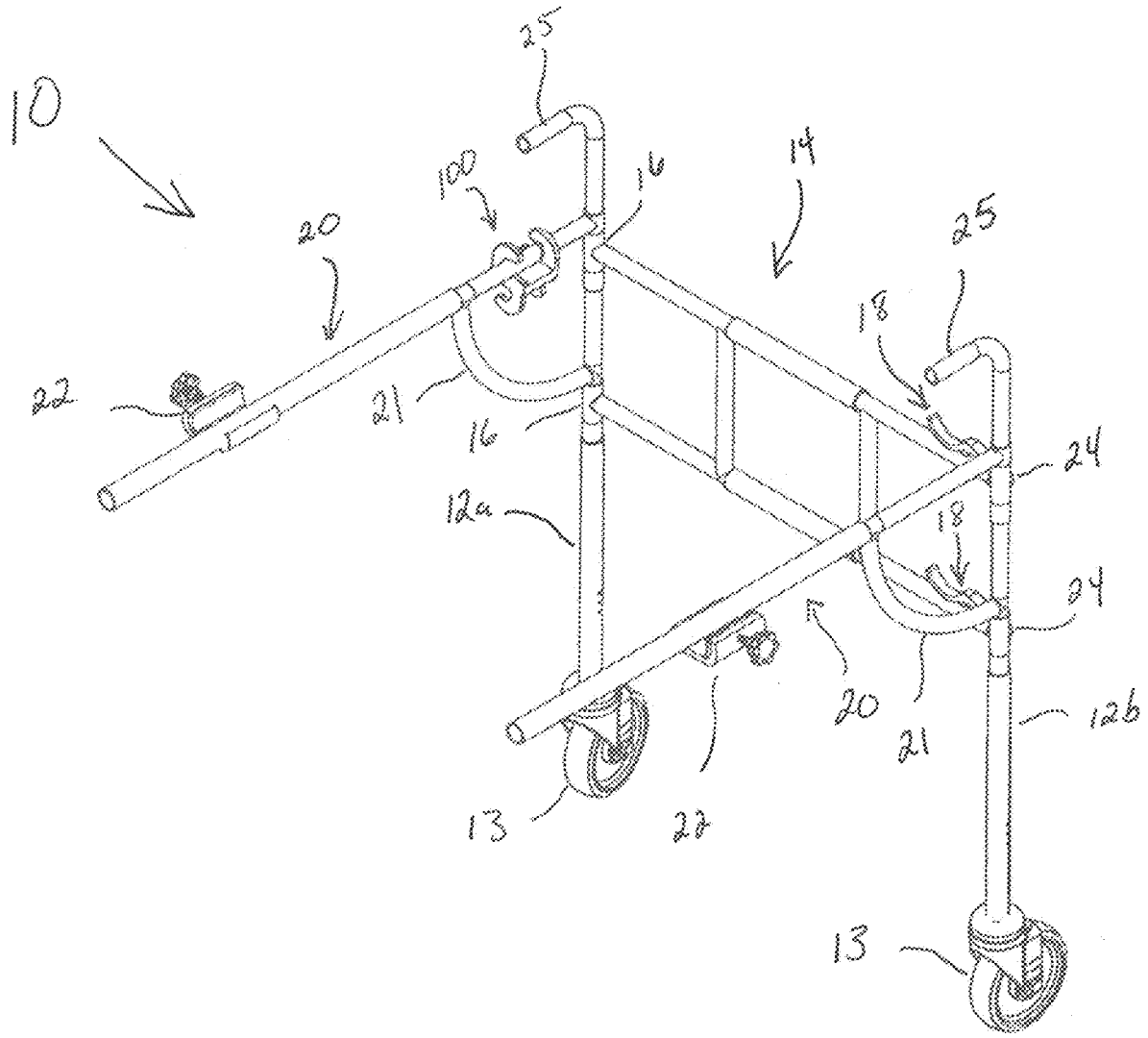
FIG. 1 is a rear perspective view of an embodiment of a walker of the present invention.

With reference to FIG. 1, a walker 10 is disclosed for use with a wheelchair W. The walker 10 may include a plurality of legs such as vertical rods 12, which may be connected by a horizontal support such as gate 14. As illustrated in FIG. 1, the vertical rods 12 may comprise a first vertical rod 12*a* and a second vertical rod 12*b*. The first and second vertical rods 12*a*, 12*b* may be left and right vertical rods. The plurality of legs may be in the form of only the first and second vertical rods 12*a*, 12*b*, with no further legs or other vertical supports supporting the weight of the walker. Each vertical rod 12*a*, 12*b* may include a wheel 13 at a lower end of the vertical rod for assisting the user in moving the walker, such as in the form of a swivel caster. The vertical rods 12*a*, 12*b* may further include a handle 25 at an upper end of the vertical rods for a user to grip when using the walker 10 for assistance with walking.

Figure 2:
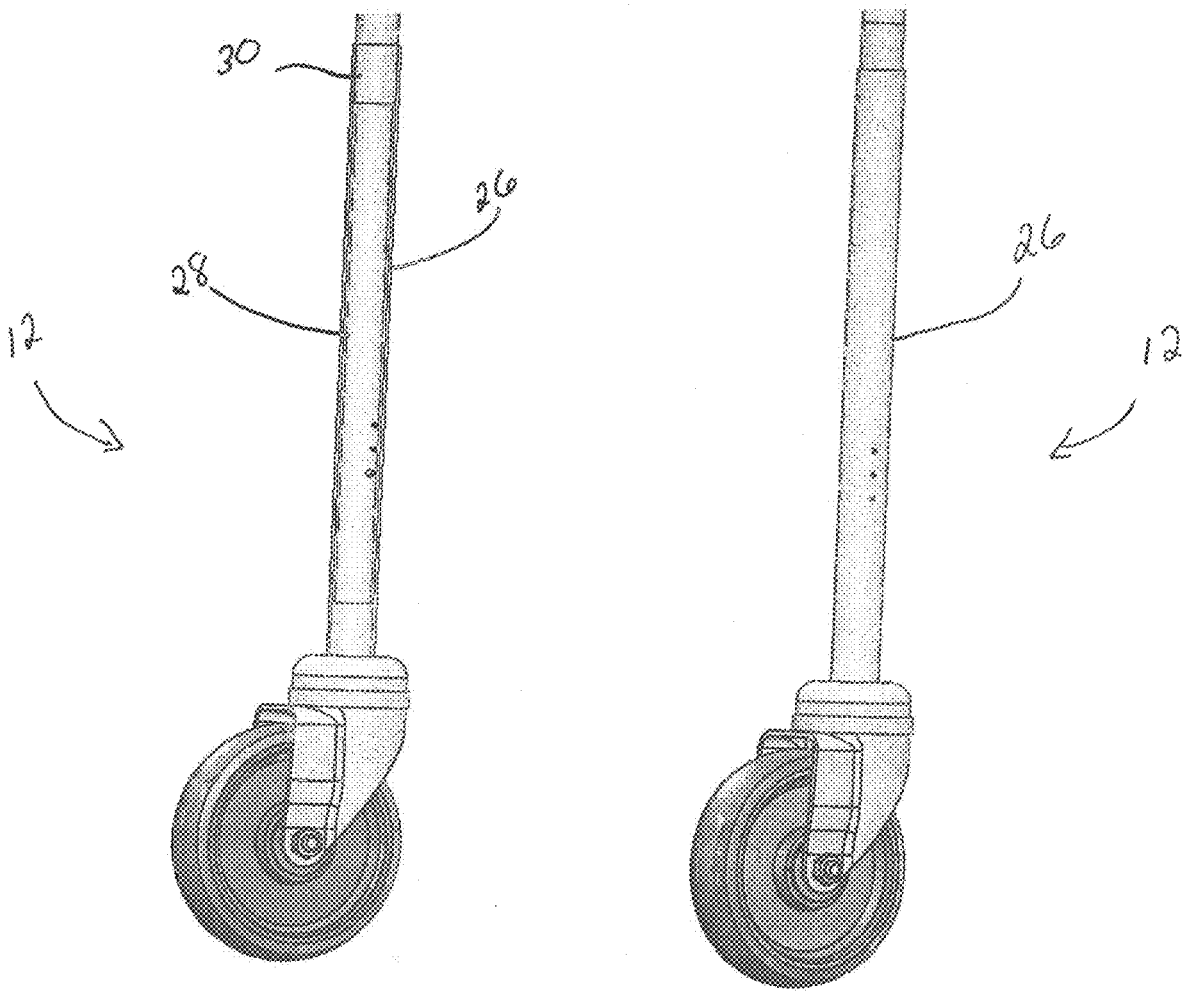
FIG. 2 is a front view of the legs of the walker of FIG. 1.

As is illustrated in FIG. 2, the vertical rods 12 may be telescoping in nature. For example, the vertical rods 12 may comprise an outer telescoping tube 26, which may slidably fit over an inner telescoping tube 28. As shown, the outer telescoping tube 26 of the left vertical rod 12 is shown as transparent so that the inner telescoping tube 28 may be seen. One or more bearings 30 may be provided for assisting the inner and outer telescoping tubes in expanding and contracting the length of the vertical rods 12. As illustrated, the bearings 30 may comprise sleeve bearings that may be press fit into the outer telescoping tube 26. One or more locking mechanisms may be provided for locking the relative longitudinal movement between the inner and outer telescoping tubes 26, 28, such as detents (e.g. detent plungers) and matching apertures.

Returning to FIG. 1, the gate 14 may be adapted to removeably, laterally attach the vertical rods 12*a*, 12*b* to one another when the walker 10 is in use. The use of the gate 14 provides stability to the walker and prevents relative movement between the vertical rods 12*a*, 12*b*. In one aspect, the gate 14 may be pivotally connected to a first vertical rod 12*a*, such as by one or more hinges 16. These hinges 16 may allow the gate 14 to pivot for connection with the second vertical rod 12*b* when the walker 10 is in use, and pivot away from the second vertical rod 12*b* when the walker 10 is not in use. In one aspect, these hinges may allow for at least 270 degrees of rotation of the gate about the hinge.

One or more gate latches 18 may be provided for removably fixing the gate 14 to the second vertical rod 12*b* when the walker is in use. The latches may allow for a user to attach the rotating gate 14 to the second vertical rod 12*b* when the walker is in use, and release the rotating gate 14 from the second vertical rod 12*b* when the walker is not in use, such as for storage. As will be described in further detail with respect to FIGS. 7A and 7B, one or more stops 24 may be provided for contacting the second vertical rod 12*b* and preventing further rotation of the gate 14.

The walker 10 may further include a plurality of wheelchair attachment supports 20 for connecting the vertical rods 12 to the wheelchair W. These supports 20 may extend from the vertical rods 12, such as in a generally horizontal direction, and may comprise beams, poles, or pipes. One or more braces 21 may be provided for connecting the supports 20 to the vertical rods 12, such as for bracing the supports 20 and maintaining a relative position between the supports 20 and the vertical rods 12. One or more clamp assemblies 22 may be provided for attaching the supports 20 to the wheelchair W, thereby providing a vertical support for the walker 10 rearward of the vertical rods 12. In one aspect, a plurality of clamp assemblies 22 may be adapted for use with each support 20.

Figure 3:
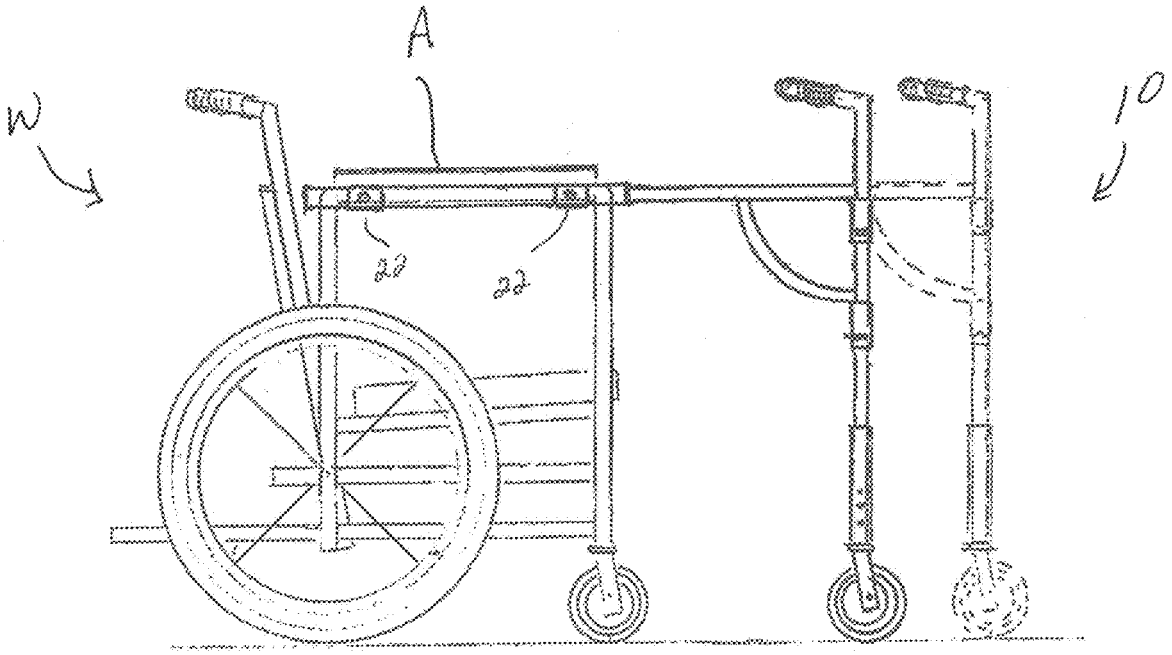
FIG. 3 is a side view of the walker of FIG. 1 attached to a wheelchair.
Figure 5A:
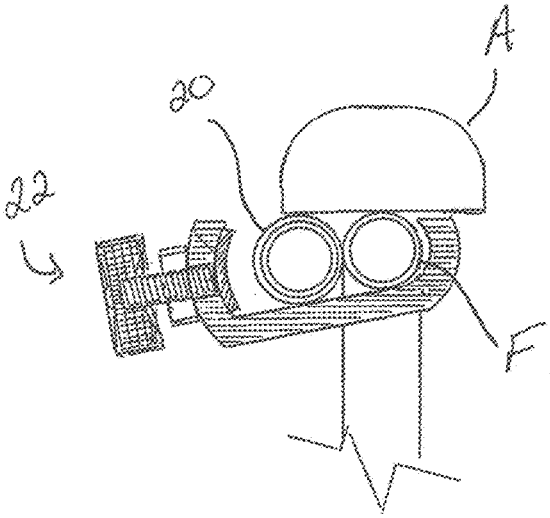
FIGS. 5A-5C illustrate a clamp assembly.

As can be seen in FIG. 3 and FIG. 5A, the clamp assemblies 22 may be adapted to removably connect the supports 20 to a frame F of the wheelchair W. The term "removably connect" means that a first element, such as the clamp assembly 22, is adapted to connect to a second element, such as the frame F of the wheelchair W, and be removed therefrom without the assistance of tools. As will be discussed in further detail below, the clamp assemblies 22 may be adapted for easy connection and removal from the frame F by the user without the assistance of any third party. In use, the walker 10 may remain attached to the wheelchair W by way of the clamp assemblies 22 when the walker is in the walking position as described herein, thereby affording the user the ability to sit down in the wheelchair whenever the user tires from using the walker. This may reduce the risk of the user falling from fatigue, such as may result by use of a traditional walker that is separate from a wheelchair.

The clamp assemblies 22 may be adapted for attachment and removal from frame F of the wheelchair W in a manner that allows the supports 20 to be connected to the frame F at different positions with respect to the wheelchair. For example, as illustrated in FIG. 3, the clamp assemblies 22 may attach the supports 20 to the frame F of the wheelchair W at a first forward position, and at a second, rearward position. This allows the user to locate the walker 10 at fixed relative positions with respect to the wheelchair W. Such manipulation of the relative position of the walker 10 with respect to the wheelchair W by way of the removable connection via the clamp assemblies 22 allows for users of different body sizes to use the walker 10 for assistance with walking (e.g. users with different arm lengths or different body proportions). Additionally, the manipulation of the relative position of the walker 10 with respect to the wheelchair W by way of the removable connection via the clamp assemblies 22 allows for a user to manipulate the walker from a walking position to a stored position. Furthermore, this manipulation of position of the walker 10 by way of the clamp assemblies 22 allows for the walker 10 to be used with wheelchairs W of different sizes.

Figure 4:
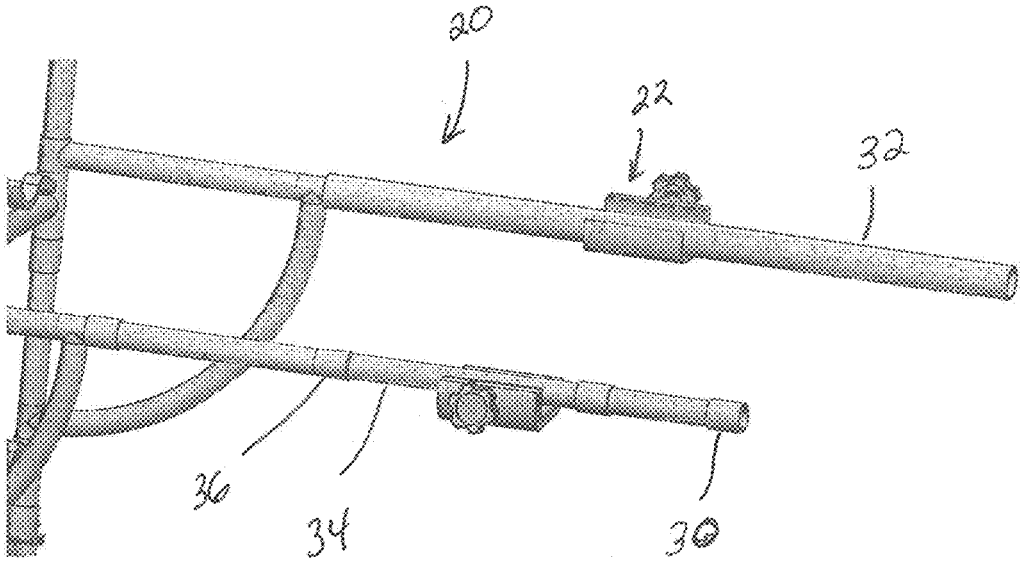
FIG. 4 is a perspective view of the supports of the walker of FIG. 1.

With reference to FIG. 4, the wheelchair attachment supports 20 are illustrated in further detail. In one aspect, the supports 20 may be telescoping in nature, thereby further assisting the user in adjusting the configuration of the walker 10 as needed. The supports 20 may include an outer tube 32 and an inner tube 34 that are adapted to slide longitudinally with respect to one another. One or more bearings 30, such as sleeve bearings, may be provided for assisting in the telescoping of the outer and inner tubes 32, 34. These sleeve bearings may be press fit into the outer tube 32, or may be press fit onto the inner tube 34.

One or more stops 36 may be provided for limiting the relative longitudinal positions of the outer and/or inner telescoping tubes 32, 34. As illustrated, the stop 36 may comprise a radially extending element attached to the inner tube 34 which may prevent further longitudinal movement of the outer tube 32 beyond said stop. In one aspect, the stop 36 may comprise one or more detents (such as detent plungers) associated with the inner tube, which are adapted to mate with one or more apertures associated with the outer tube. The stop 36 may be positioned at a medically relevant position, such as at a distance large enough to allow the user to stand from the wheelchair W and use the walker 10 with sufficient room between the walker 10 and the wheelchair W for the user's legs to be used to ambulate. In one example, the stop 36 may be positioned approximately 15 inches along the inner tube 34 from the vertical rod 12. The stop 36 may be positioned so as to allow the walker 10, once attached to the frame F of the wheelchair W, to be extended by the user by way of the telescoping nature of supports 20 from the stored position to the walking position.

Figure 5B:
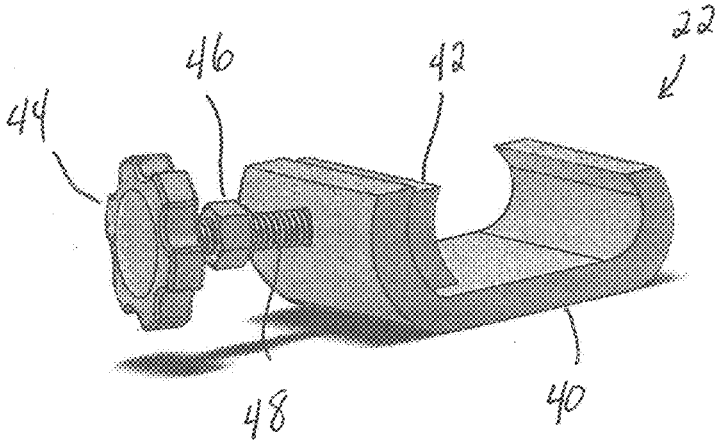
Figure 5C:
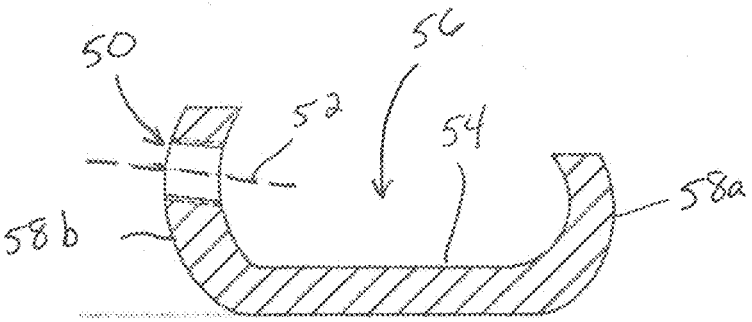

With further reference to FIGS. 5A-5C, the details of the clamp assembly 22 are further indicated. The clamp assembly 22 may include a clamp body 40, which may include a base 54 located between first and second sides 58*a*, 58*b*. The sides 58*a*, 58*b* may be arcuate in cross-section so as to coordinate with a rounded frame element F associated with an arm A of the wheelchair W and/or with a rounded support 20 of the walker 10. The curved nature of the sides 58*a*, 58*b* may cushion and/or prevent movement of the walker 10 with respect to the frame F when the clamp assembly 22 is in use. The base 54 and sides 58*a*, 58*b* may define a recess 56 therebetween. As can be seen in FIG. 5A, the clamp assembly 22 may be adapted to hold both a portion of the frame F of the wheelchair W and the support 20 of the walker 10 within the recess 56 of the clamp assembly 22.

The clamp assembly 22 may further include a sliding head 42. The sliding head 42 may be adapted for movement within the recess 56 of the body 40 and be adapted to apply a pressure to a body within the clamp assembly 22, thereby fixing the clamp assembly in place. The sliding head 42 may also be arcuate in cross-section so as to coordinate with a rounded frame element F or a rounded support 20 of the walker 10. With further reference to FIG. 5A, upon placement of both a portion of the frame F of the wheelchair W and the support 20 of the walker 10 within the recess 56, the sliding head 42 may be actuated from the second side 58*b* toward the first side 58*a* of the body 40, thereby applying pressure to both the support 20 and the frame F of the wheelchair W, and fixing the walker 10 to the wheelchair W.

The clamp assembly 22 may include a screw 44 adapted to move the sliding head 42 back and forth within the body 40 of the clamp assembly 22. The screw 44 may pass through an aperture 50 in the body 40. The aperture 50 may be threaded to receive the screw, or a helical insert 48 may be provided within the aperture 50 for receiving the screw 44. A locking nut 46 may be provided for limiting the distance that the screw 44 may travel, thereby limiting the range of motion of the sliding head 42 within the recess 56. In one aspect, the aperture 50 may be oriented with a longitudinal axis 52 which is offset at an angle from the base 54 of the body 40. This offset angle may cause the screw 44 to apply a force to the sliding head 42 that has both a horizontal factor across the recess 56 from one side 58*b* to the other side 58*a*, as well as a vertical factor from a top of the recess 56 toward the base 54 of the body 40. This directional force applied to the sliding head 42 by way of the angled orientation of the aperture 50 biases the support 20 and the frame F of the wheelchair downward and into the first side 58*a* of the clamp body 40, thereby better securing the walker 10 and wheelchair W to one another. Overall, the screw-based attachment and disengagement of the clamp assembly 22 allows the user to easily attach, disengage, and reposition the walker 10 with respect to the wheelchair W. this is at least because the attachment location of the walker 10 to the wheelchair W is along the armrest A of the wheelchair W, which is easily accessible to the user.

Figure 6:
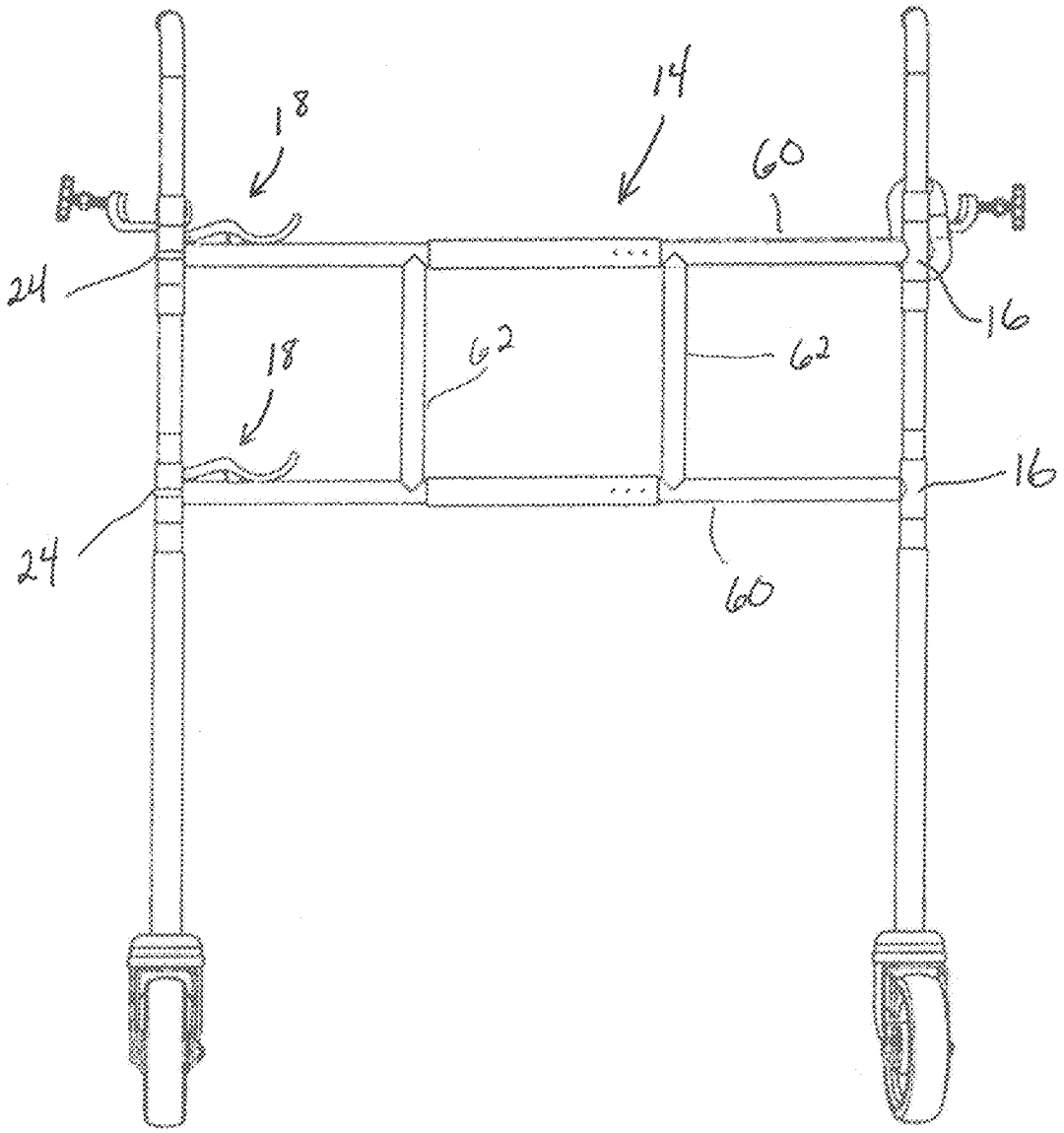
FIG. 6 is a front view of the walker of FIG. 1 in the walking position.

Turning to FIG. 6, the gate 14 may be seen from the front of the walker. The gate 14 may include one or more cross beams 60. The cross beams 60 may span from the first vertical rod 12*a*, connected at the hinge 16, to the stop 24, said stop 24 adapted to contact the second vertical rod 12*b* when the gate 14 is in the closed configuration. This closed configuration may be achieved by joining the gate 14 with the second vertical rod 12*b* by way of the latch 18. In the embodiment in which a plurality of cross beams are present, as is illustrated in FIG. 6, one or more connecting beams 62 may be provided. These connecting beams 62 connect the cross beams 60 and provide support and stability to the gate.

As illustrated, the cross beams 60 are substantially horizontal and the connecting beams 62 are substantially vertical.

Figure 7A:
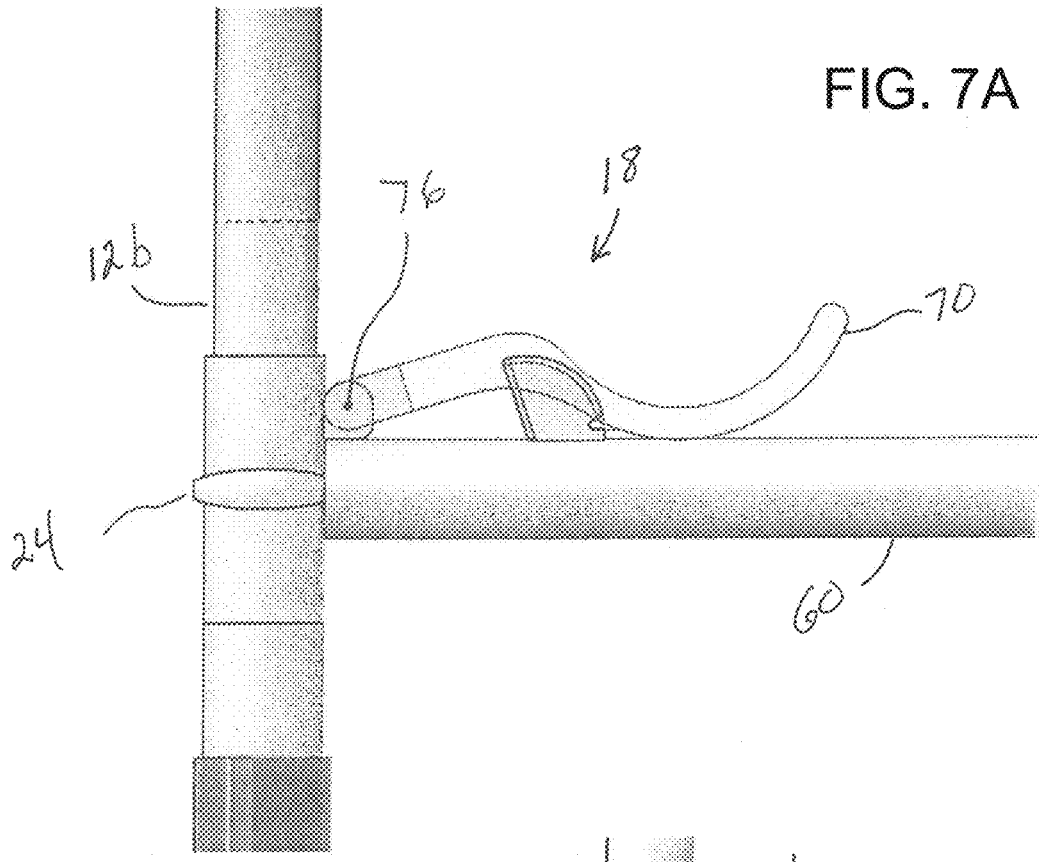
FIGS. 7A and 7B illustrate a latch of the gate of the walker of FIG. 1.
Figure 7B:
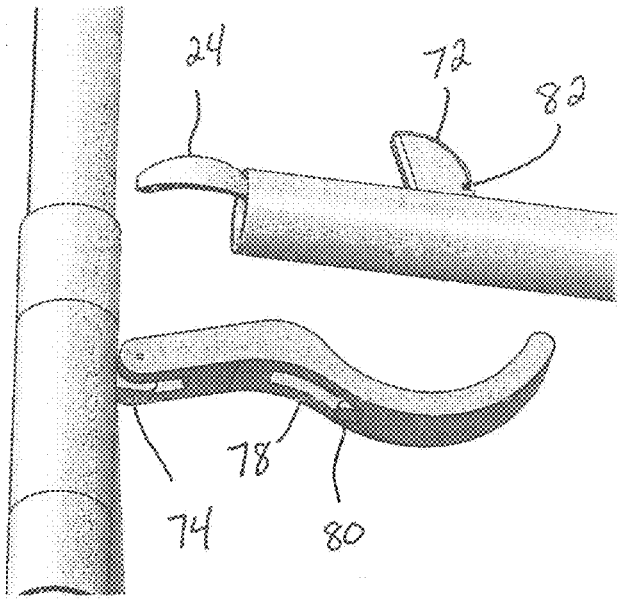

The latch 18, as illustrated in FIGS. 7A and 7B, may be used to attach the pivotable gate 14 to the second vertical rod 12*b*. FIG. 7A illustrates the latch 18 in the closed configuration, while FIG. 7B illustrates the latch 18 in the open configuration. The latch may include a lever arm 70 attached to the second vertical rod 12 by, such as by anchor 74. The lever arm 70 may be adapted to rotate with respect to the anchor 74, such as via a spring pin 76. The spring pin 76 may bias the lever arm 70 in a given direction, such as downward. The gate 14 may include a catch 72 for engaging the lever arm 70 when the latch 18 is in the closed configuration. The catch 72 may be located on a cross beam 60 of the gate 14. In practice, the catch 72 may be received by the lever arm 70, such as within recess 78. As illustrated, the catch 72 may be arcuate in shape along a top of the catch in order to facilitate the receipt of the catch 72 by the recess 78. In order to further secure the latch 18 in the closed configuration, the lever arm 70 may include a lip 80 that may be received by a notch 82 associated with the catch 72.

In use, the user may swing the gate 14 from the stored position to the walking position in which the gate 14 is attached to the second vertical rod 12*b*. As the gate 14 approaches the second vertical rod 12*b*, the user may raise the lever arm 70 and cause the stop 24 to contact the second vertical rod 12*b*. The lever arm 70 may then be rotated down over the catch 72 in order to secure gate 14 in connection with the second vertical rod 12*b*. The lip 80 may engage the notch 82 as the catch 72 is received within the recess 78 of the lever arm 70, thereby locking the walker 10 in the walking configuration.

Figure 8:
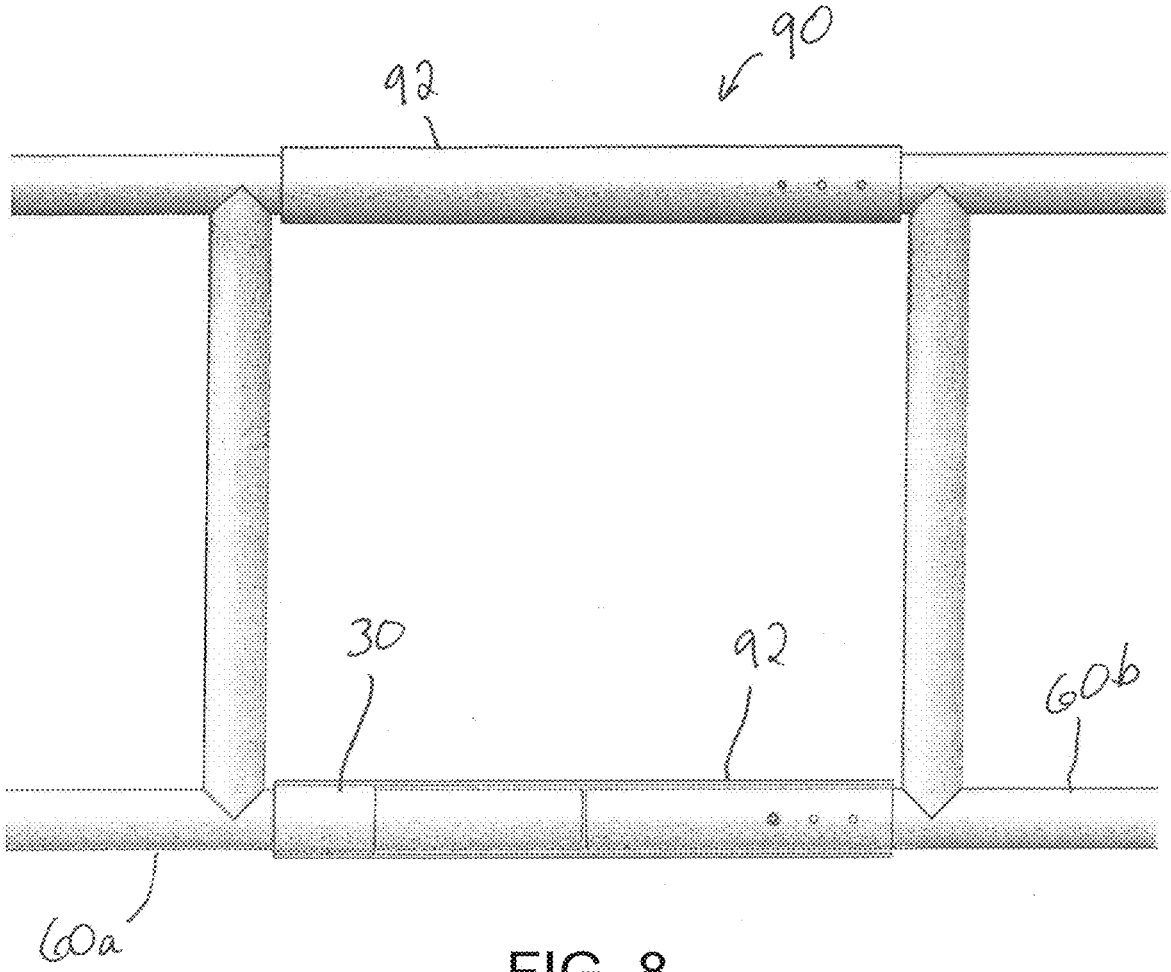
FIG. 8 is a front view of the expandable section of the gate of the walker of FIG. 1.

With further reference to FIG. 8, the gate 14 is illustrated with an extendible section 90. The extendible section may be adapted to allow a width of the gate to be expanded from a first width to a second width. This ability to expand the width of the gate 14 allows the walker 10 to be utilized with different wheelchairs W of different widths.

As illustrated, the extendible section 90 may comprise an outer tube 92, which may be positioned over the cross beam 60. As shown in FIG. 8, the cross beam 60 may comprise a first cross beam section 60*a* that aligns with but is separated from a second cross beam section 60*b*. The lower of the two outer tubes 92 of FIG. 8 is shown as transparent so that the first cross beam section 60*a* and the second cross beam section 60*b* may be seen. The outer tube 92 may receive at least a portion of the first cross beam section 60*a* and the second cross beam section 60*b*, and may allow relative longitudinal movement of at least one of the first cross beam section 60*a* and the second cross beam section 60*b* within the outer tube 92. One or more bearings 30 may be provided for facilitating relative longitudinal movement between the outer tube 92 and at least one of the first and second cross beam sections 60*a*, 60*b*.

One or more stops may be provided for preventing and allowing relative movement between the outer tube 92 and at least one of the first and second cross beam sections 60*a*, 60*b*. For example, one or more detents (such as detent plungers) may be associated with the first and/or the second cross beam sections 60*a*, 60*b*, which may be adapted to coordinate with one or more apertures on the outer tube 92. Actuation of the detent may allow for the outer tube 92 to slide with respect to one or more of the first and second cross beam sections 60*a*, 60*b*, such as for a fixed distance, until the detent moves from a first aperture in the outer tube 92 to a second aperture in the outer tube. This movement of the outer tube 92 with respect to at least one of the first and second cross beam sections 60*a*, 60*b* allows for expansion and contraction of the width of the gate 14.

Referring again to FIG. 1, a retainer 100 may be provided for retaining the gate 14 in the stored position. When the latch 18 is released and the gate 14 is disconnected from the second vertical rod 12*b*. The gate 14 may be adapted to rotate about the first vertical rod 12*a* by way of hinges 16 into the stored position. For example, the gate 14 may be rotated approximately 270 degrees from the walking configuration until the cross beams 60 of the gate 14 are substantially parallel with the support 20 extending from the first vertical rod 12*a*. The retainer 100 may be used to lock the gate 14 in this position. Once the gate has been rotated into the stored position, the wheelchair W may be used as a wheelchair with the user seated therein without interference from the walker 10, but while the walker 10 remains attached to the wheelchair. When the user wishes to use the walker 10 again, the gate 14 may be released from the retainer 100 and rotated about hinges 16 until it may be reattached to the second vertical rod 12*b* again.

Figure 9:
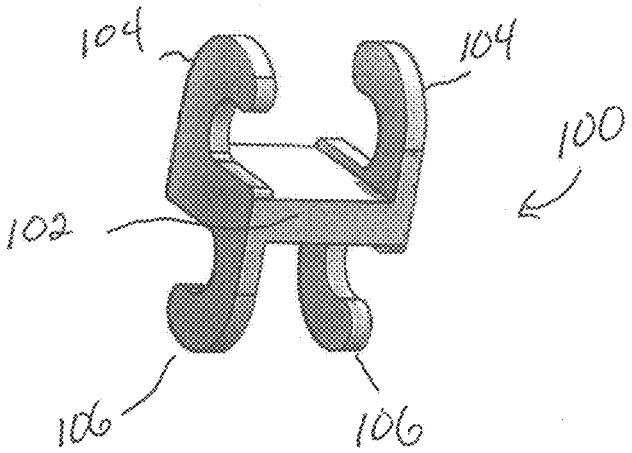
FIG. 9 is a perspective view of a retainer for locking the gate of the walker of FIG. 1 in a stored position.

With further reference to FIG. 9, one embodiment of the retainer 100 will be described in further detail. As shown, the retainer 100 includes a base 102 from which one or more first extensions 104 and one or more second extensions 106 extend. The first extensions 104 may be adapted to attach the retainer to the support 20 attached to the first vertical rod 12*a*. The second extensions 106 may be adapted to attach the gate 14 to the retainer 100 when the walker is in the stored position. As illustrated, the first extensions 104 comprise laterally spaced, oppositely facing arc-shaped members. These oppositely facing arc-shaped members are adapted to retain the support 20 therebetween. Similarly, the second extensions 106 comprise laterally spaced, oppositely facing arc-shaped members, which are adapted to retain a cross beam 60 of the gate 14 therebetween. In one aspect, the retainer 100 may be made of a flexible material, such that the extensions 104, 106 are adapted to bend to allow the support 20 and the cross beam 60, respectively, to be placed between said extensions. For example, the retainer may be made at least partially of rubber or plastic.

With reference to FIGS. 10A-10D, a second embodiment of a device, namely a walker 200 adapted for attachment to a wheelchair, is illustrated. The walker 200 may comprise a frame including a first lateral frame member 201*a* and a second lateral frame member 201*b*. Upon assembly and connection to a wheelchair, the first lateral frame member 201*a* and the second lateral frame member 201*b* may be attached to each side of the wheelchair.

Each of the first lateral frame member 201*a* and the second lateral frame member 201*b* may include an extension portion 202 and a walker portion 204. The extension portion 202 may be adapted to attach to a wheelchair, such as a frame of the wheelchair (not shown). As illustrated, the extension portion may generally be elongated in a direction from an anterior position to a posterior position with respect to the wheelchair.

In one aspect, the extension portion 202 may include a clamp assembly 240 which may be adapted to be attached to the wheelchair. Once the clamp assembly 240 is attached to the wheelchair, the remainder of the frame may be adapted to move with respect to the clamp assembly 240, such that the remainder of the frame may extend between a posterior position and an anterior position. This may allow for storage and use of the walker, respectively.

Figure 11A:
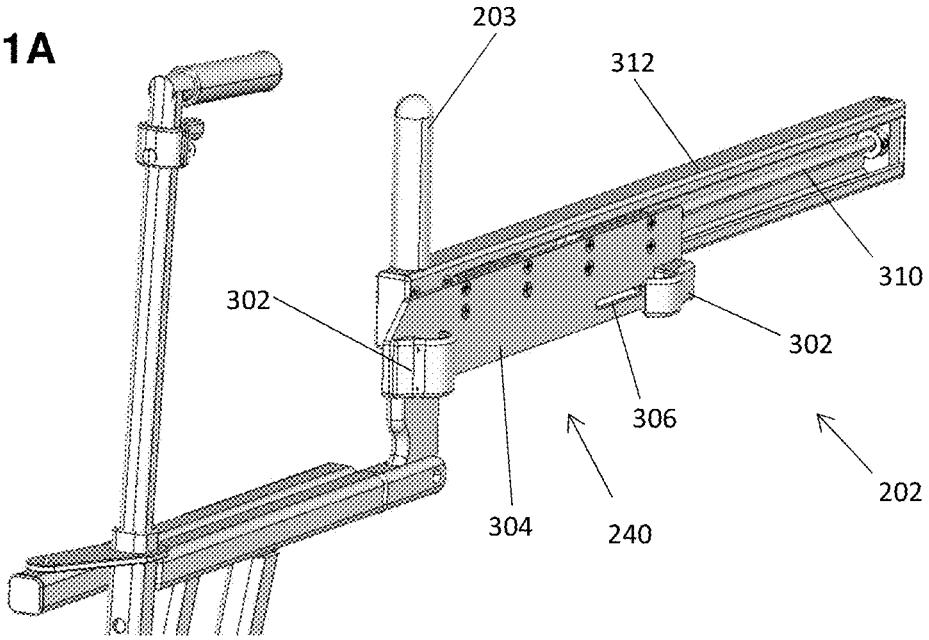
FIGS. 11A and 11B are perspective views of an extension portion of the second embodiment of the walker.
Figure 11B:
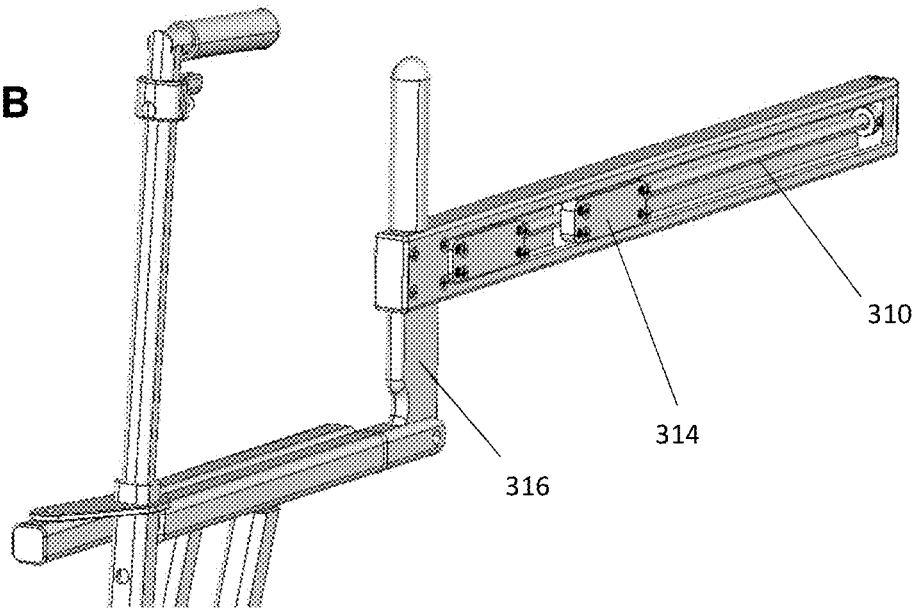

With further reference to FIGS. 11A and 11B, the clamp assembly 240 may include one or more clamps 302 adapted to engage a portion of the wheelchair. For example, the clamps 302 may be adapted to be secured to a frame of the wheelchair, such as below an armrest of the wheelchair.

The clamps 302 may be secured to a clamp mount 304, which may be a plate, block, or other member to which a clamp may be attached. The combination of the clamps 302 with the clamp mount 304 may form the clamp assembly 240. In one aspect, the clamp 302 may be attached to the clamp mount 304 via a mounting aperture 306. A fastener (not pictured), such as a bolt, locking pin, or other locking device, may be used to secure the clamp 302 to the clamp mount 304. As illustrated, the mounting aperture 306 may be an elongated aperture adapted to allow for the mounting of the clamp 302 at a plurality of positions along the clamp mount 304. This may allow for adjustability such that the walker 200 may be attached to wheelchairs of different sizes or different frame configurations.

The extension portion 202 may further include an extension housing 312 along which the clamp assembly 240 may travel. The extension portion 202 may include a connecting member 316 for connecting to the walker portion.

In one example, an extension rod 310 may be provided, such as within the extension housing 312, along which the clamp assembly 240 is adapted to slide. As shown in FIG. 11B, one or more mounting blocks 314 (which may be in the form of a block or plate) may be provided. The clamp mount 304 may be attached to the mounting block 314, thereby allowing the clamp assembly 240 to travel along a length of the extension rod 310. In one aspect, the mounting block 314 may include an aperture through which the extension rod 310 passes, thereby allowing the relative movement.

Returning to FIGS. 10A and 10B, the walker 200 is illustrated in a fully retracted position (FIG. 10A) and an extended position (FIG. 10B). When the clamp assembly 240 is secured to the wheelchair, movement of the clamp assembly 240 with respect to a remainder of a frame of the walker 200, the remainder of the frame is allowed to extend and retract with respect to the wheelchair, traveling along a direct from the anterior position to the posterior position with respect to the user sitting in the wheelchair. A grip 203 may be provided for allowing a user of the walker 200 to extend and retract the remainder of the frame of the walker 200 while seated in the wheelchair.

The walker portion 204 includes a gate 214 adapted to provide stability when in use and to connect the first lateral frame member 201*a* and the second lateral frame member 201*b*. The gate 214 may be pivotable between a deployed position in which the gate 214 spans between and connects the first lateral frame member to the second lateral frame member, and a stowed position in which the gate does not connect the first lateral frame member to the second lateral frame member. One or more hinges 216 may be provided about which the gate 214 may pivot.

Figure 10A:
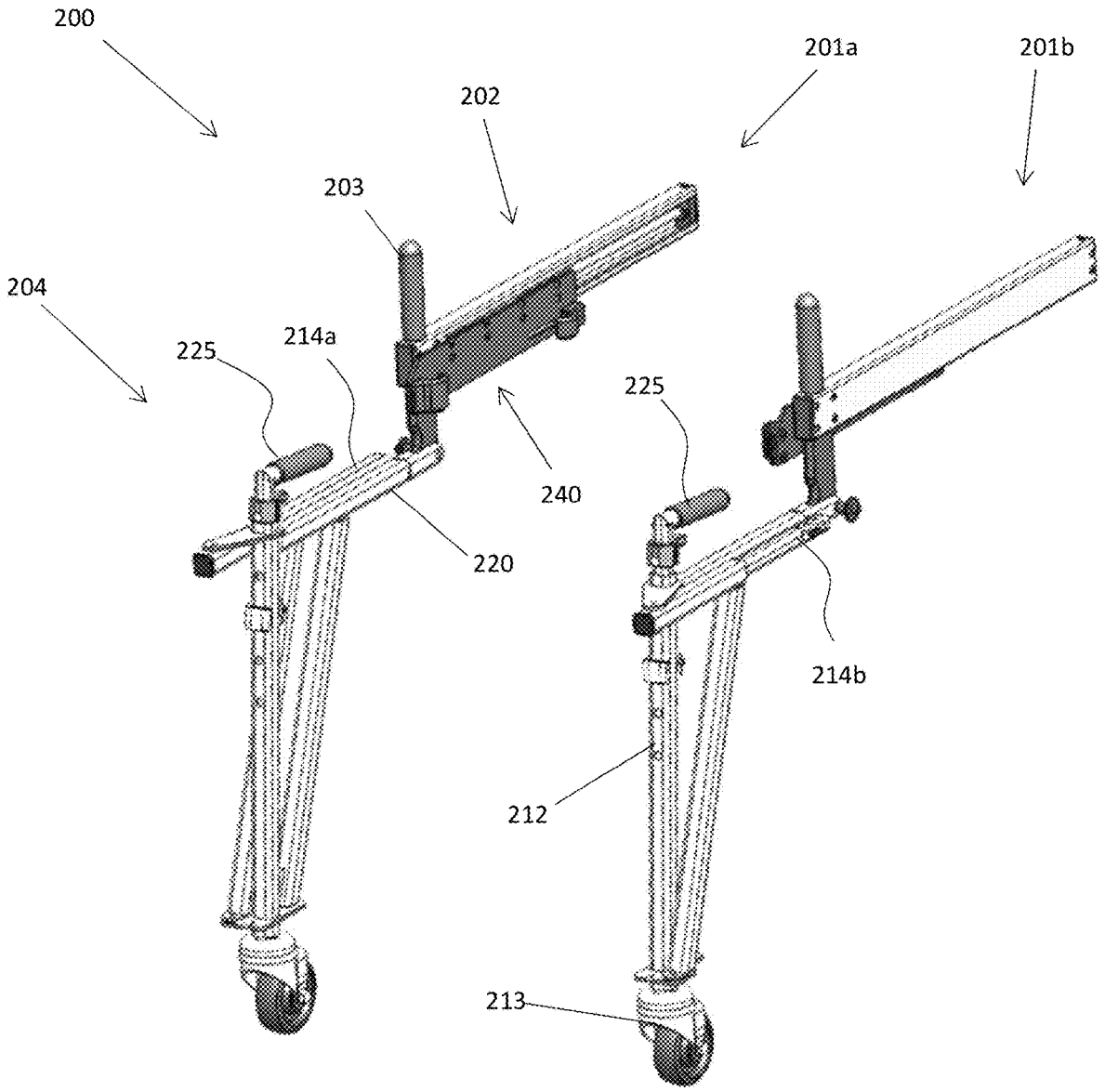
FIGS. 10A-10D are perspective views of a second embodiment of a walker of the present invention.
Figure 10B:
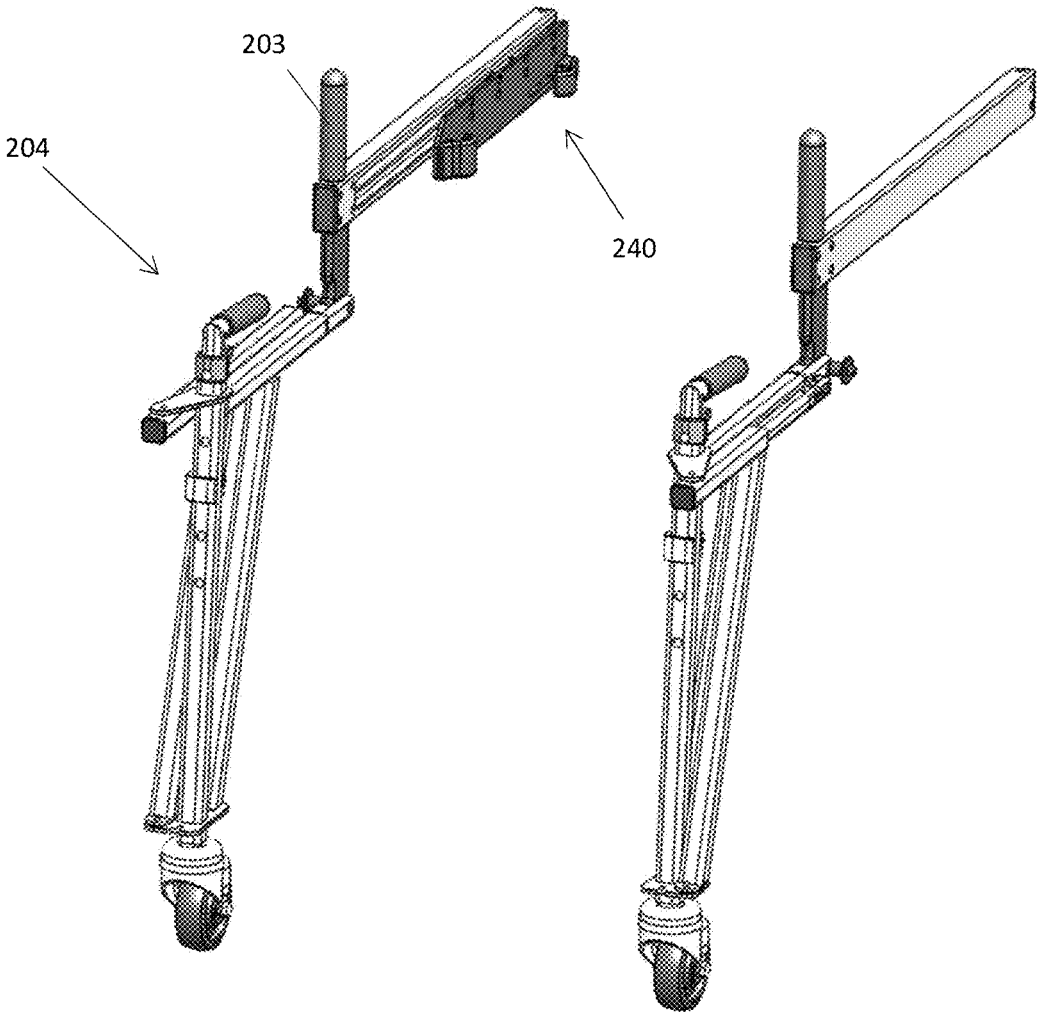
Figure 10C:
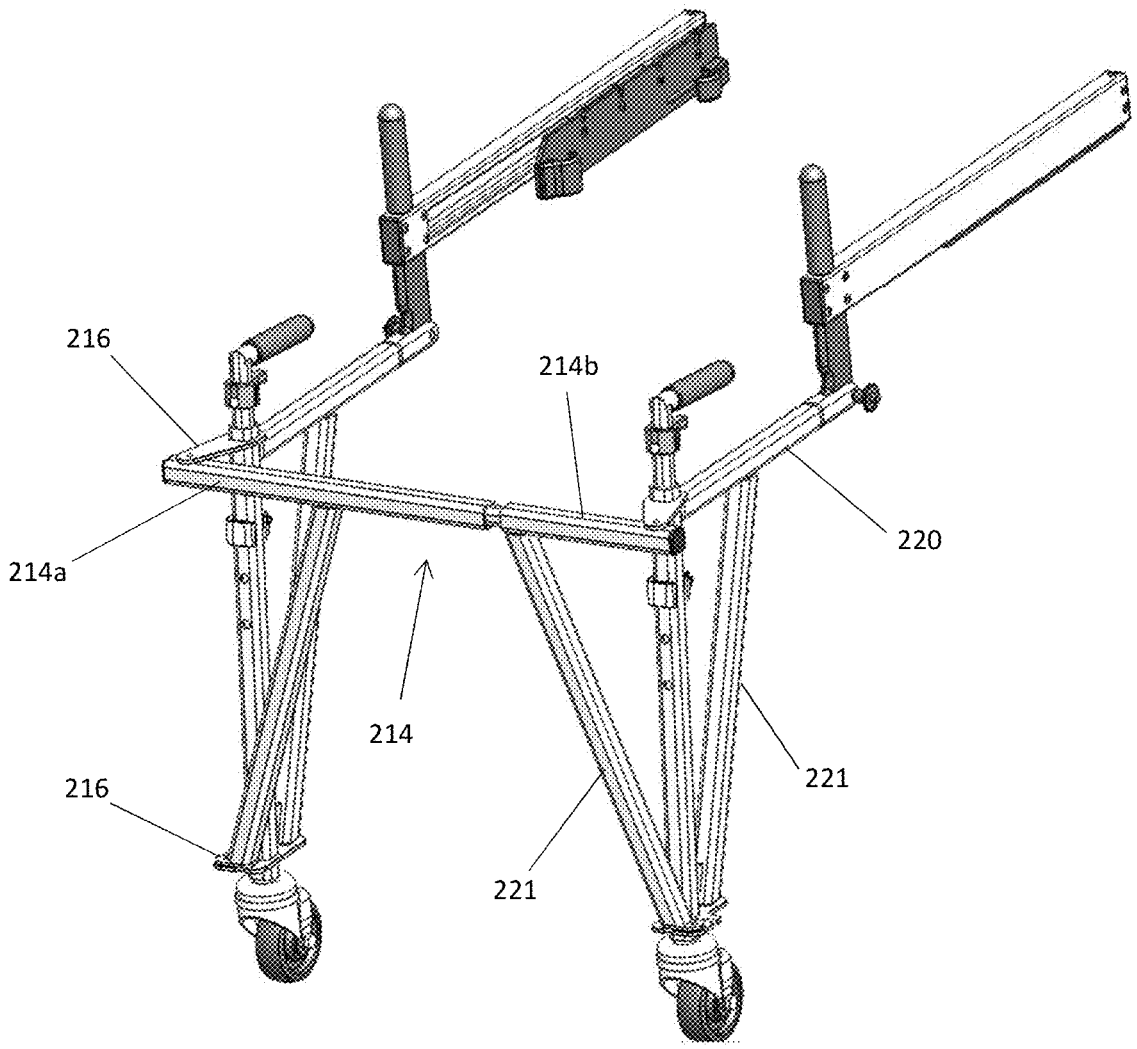
Figure 12A:
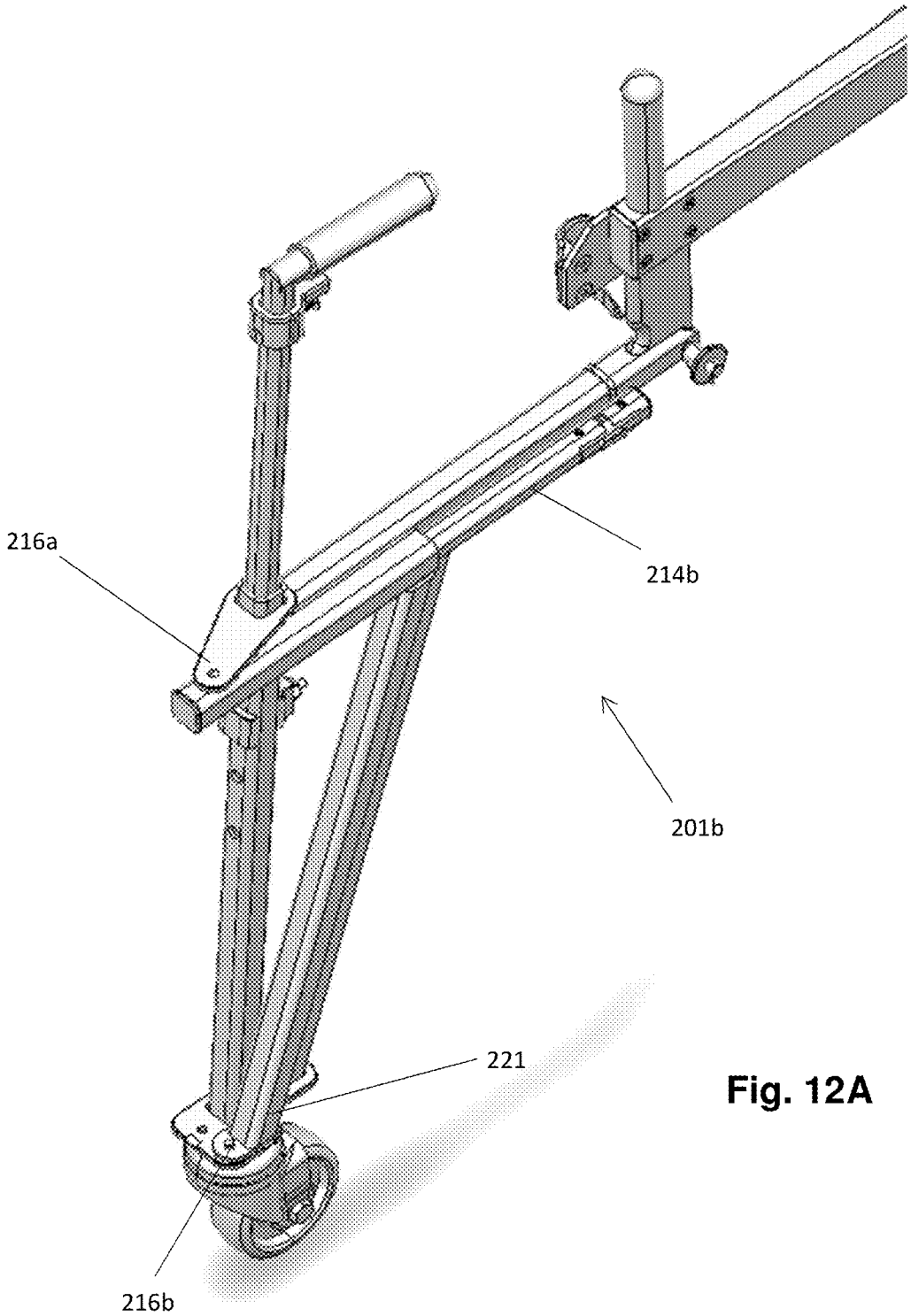
FIG. 12A is a perspective view of a walker portion of the second embodiment.

With reference to the transition between the configuration of the walker 200 from FIG. 10B to FIG. 10C, as well as the configuration of FIG. 12A, the gate 214 may be parallel to the direction from the anterior position to the posterior position in the stowed position (i.e. FIG. 10B and FIG. 12A). And as illustrated in FIG. 10C, the gate may be perpendicular to the direction from the anterior position to the posterior position in the deployed position.

The gate 214 may comprise a first gate member 214*a* and a second gate member 214*b*. As shown, the first gate member 214*a* may be connected to the first lateral frame member 201*a* and the second gate member 214*b* may be connected to the second lateral frame member 210*b*. Each of the first gate member 214*a* and the second gate member 214*b* may be parallel to the direction from the anterior position to the posterior position in the stowed position.

The walker portion 204 may further include at least one support rod 220 adapted to connect to the extension portion 202 of the walker 200. The support rod 220 may add support and rigidity to the frame of the walker 200. As illustrated, each of the first and second lateral frame members 201*a*, 201*b* includes a support rod 220.

In one aspect, the support rod 220 may be horizontal in use. The support rod 220 may be parallel to the direction from the anterior position to the posterior position, such that the gate 214 or the first gate member 214*a* and the second gate member 214*b* may be parallel to the support rod 220 in the stowed position (see FIGS. 10B and FIG. 12A).

One or more braces 221 may be provided for stabilizing the support rod 220. As illustrated, a brace 221 may span from the support rod 220 to the wheel 213. One or more braces 221 may be provided for stabilizing the gate 214 as well. As illustrated, each of the first and second gate members 214*a*, 214*b* may be supported by a brace 221. The brace 221 may span from the first or second gate member 214*a*, 214*b* to the wheel 213.

Figure 12B:
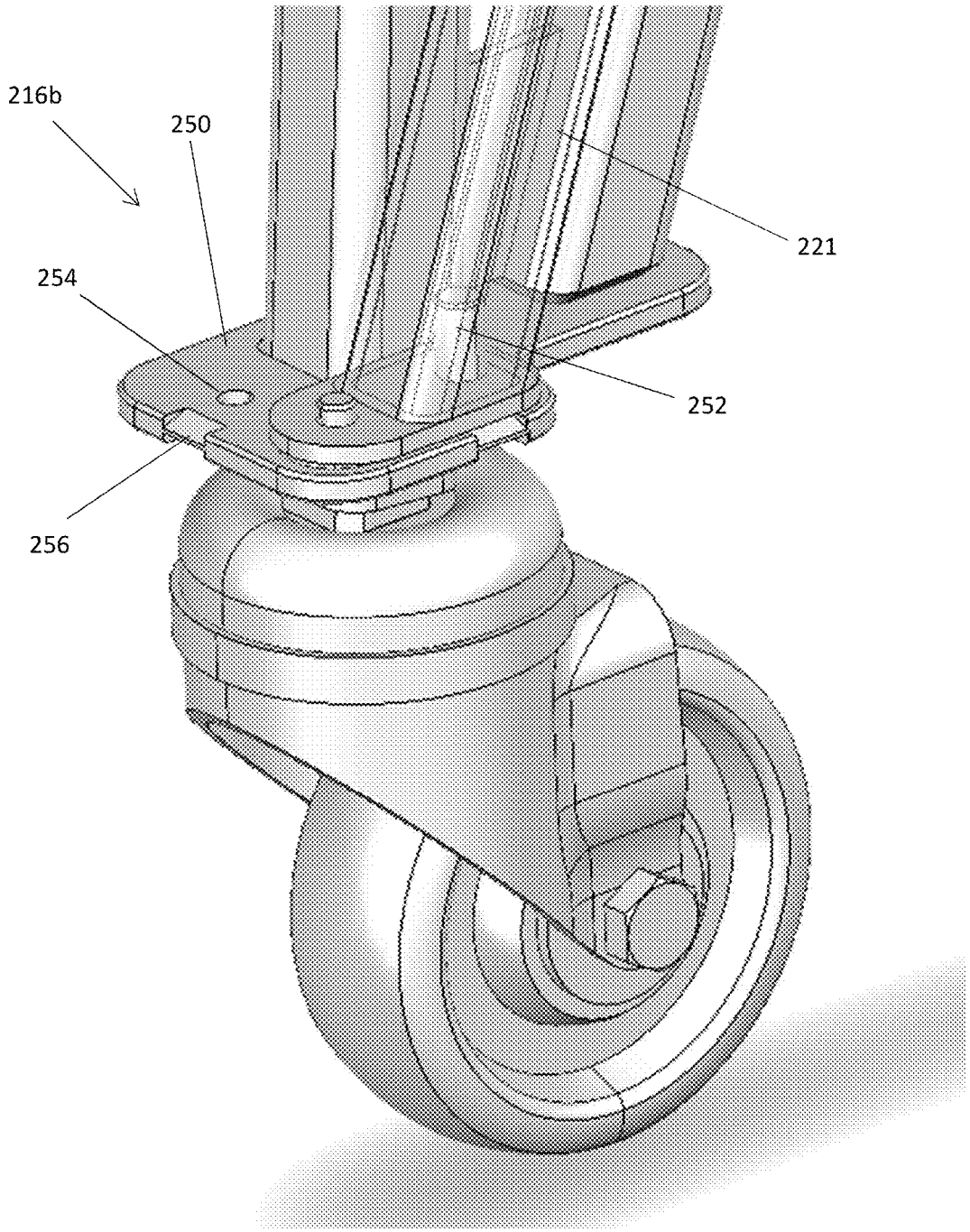
FIG. 12B is a hinge of a gate of the walker portion of FIG. 12A.

Turning to FIGS. 12A and 12B, the gate 214 may be adapted to pivot about a plurality of hinges 216. For example, the first or second gate member 214*a*, 214*b* may pivot about a first hinge 216*a*, while a brace 221 attached to a respective first or second gate member 214*a*, 214*b*, may pivot about a second hinge 216*b*. Each of the first hinge 216*a* and the second hinge 216*b* may be associated with a hinge plate.

FIG. 12B illustrates a detailed view of a hinge plate 250 associated with the second hinge 216*b*. A brace 221 (illustrated as transparent) may be a brace connected to a gate member, such as the second gate member 214*b*. A lower end of the brace 221 may be adapted to pivot about a point on the hinge plate 250 as the gate 214 is pivoted between the stowed and the deployed position. As shown in FIG. 12B, the gate 214 is in the stowed position, such as is illustrated in FIGS. 10A-10B. The brace 221 may include a releasable lock, such as pin 252 which may be adapted to engage an aperture 254 in the hinge plate 250. The pin 252 may be biased, such as a spring pin, such that is at least partially hindered from moving once engaged with an aperture. For example, the pin 252 may include a rounded bottom that may at least partially be inserted into an aperture, but may be removed from the aperture via application of sufficient lateral force.

Although not visible, the pin 252 in FIG. 12B is engaged with a first aperture 254 to maintain the gate 214 in the stowed position. Upon application of sufficient lateral force, such as from a user pushing a first or second gate member 214*a*, 214*b* in a lateral direction, the pin 252 may disengage with the aperture 254, and the gate member may pivot about the pivot point on the hinge plate 250 until the pin 252 engages a second aperture 254, thereby fixing the gate in the deployed position. One or more inclines 256 may be provided for assisting in the partial retraction of the pin 252 as the brace 221 pivots from one position to another. Once the brace 221 pivots to the point at which the pin 252 is positioned above the second aperture 254, the pin 252, due to its bias, may be at least partially held in place by the second aperture 252 to maintain the gate in the deployed position. In one aspect, the gate 214 or gate member 214*a*, 214*b* may be adapted to rotate approximately 270 degrees between the stowed and the deployed positions.

Figure 13:
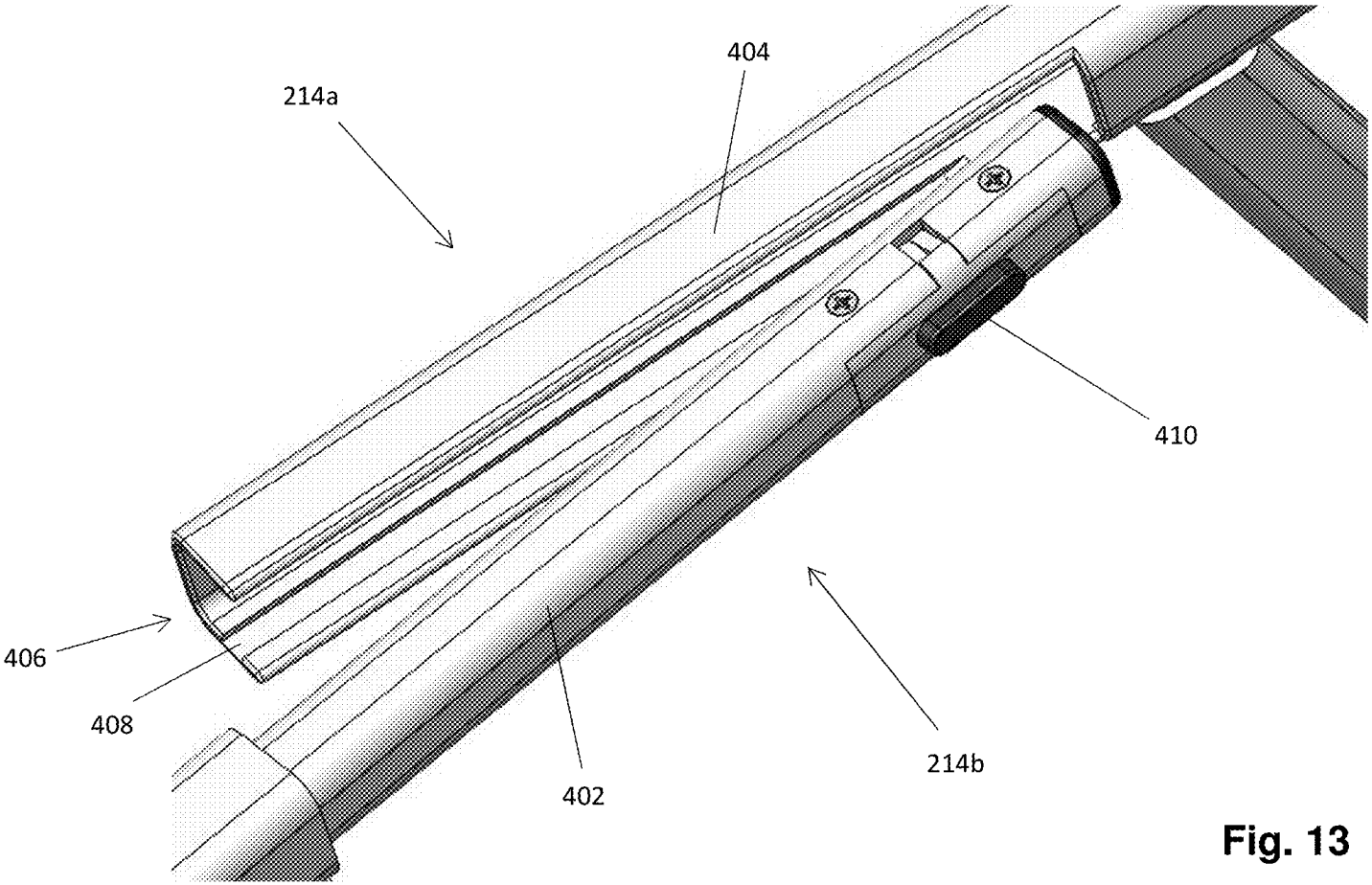
FIG. 13 is a connection portion of a gate of the second embodiment.

Turning to FIG. 13, a connection between the first gate member 214*a* and the second gate member 214 is illustrated.

The first gate member 214*a* may include a receiving portion 404 adapted to receive at an insertion portion 402 of the second gate member 214*b*. In one aspect, the first gate member 214*a* and the second gate member 214*b* are adapted to engage each other to form the gate 214 with a plurality of different widths. Once engaged, the gate 214 connects the first lateral frame member 201*a* to the second lateral frame member 201*b*. The plurality of different widths allowed by the connection of the first gate member 214*a* and the second gate member 214*b* allows for the use of a single walker 200 to be used with wheelchairs of different widths. Accordingly, when the first and second lateral frame members 201*a*, 201*b* are connected to the sides of a wheelchair, the ability of the first gate member 214*a* to the second gate member 214*b* at a plurality of different widths between said first and second lateral frame members 201*a*, 201*b* allows for connection to form the gate 214, regardless of the width of the wheelchair. For example, the first and second lateral frame members 201*a*, 201*b* may be adapted to attach to wheelchairs with seat widths of between 16-20 inches (e.g. 16 inches, 18 inches, or 20 inches wide), while still allowing the first and second gate members 214*a*, 214*b* to connect to form the gate 214 while attached to the wheelchair. These seat widths may correspond to wheelchairs with a frame width of between 18-22 inches (e.g. 18 inches, 20 inches, or 22 inches wide).

The receiving portion 404 may include a receiver 406, which may be adapted to receive at least a portion of the insertion portion 402. The receiver 406 may comprise an aperture, an opening, or a recess. As illustrated, the receiver 406 comprises an opening elongated in a longitudinal direction along the length of the first gate member 214*a*. The receiver 406 may be opened such that the insertion portion 402 may be pivoted into the receiver 406 as the first and second gate members 214*a*, 214*b* pivot from the stowed to the deployed positions. For example, the receiver 406 may be positioned along a face of the receiving portion 404 facing a posterior direction of the user when the gate 214 is in a deployed condition. Accordingly, if the second gate member 214*b* is pivoted to the deployed position, and then the first gate member 214*a* is pivoted to the deployed position, the receiver 406 of the first gate member 214*a* will receive the insertion portion 402 of the second gate member 214*b*. In one aspect the receiving portion 404 is opened at an end of the first gate member 214*a*, thereby allowing the entire cross-section of the insertion portion 402 to be received within the receiver 406.

The elongated nature of the receiver 406 allows for the insertion of the insertion portion 402 at a plurality of different longitudinal positions along the receiving portion 404. The nature of this elongated receiver 406 allows for a continuous number of positions of connection between the gate members as opposed to a discrete set of positions. This flexibility in the relative position of the insertion portion 402 and the receiving portion 404, while still allowing for connection therebetween, allows for a plurality of different widths of the gate 214 formed by the connection of the first and second gate members 214*a*, 214*b*. This also allows for engagement of the first and second gate members 214*a*, 214*b* to form the gate 214 with the first and second lateral frame members 201*a*, 201*b* ad various widths therebetween due to their connection to wheelchairs of various widths.

In one aspect, the receiver 406 may include at least one recess 408 therein. The recess 408 may comprise an indentation, a channel, or a groove. As shown, the recess 408 is a channel positioned along a longitudinal axis of the receiving portion 404 within the receiver 406. A second recess 408 may be provided, such as along an opposing wall of the interior of the receiver 406 from the first recess 408. The recess 408 may be adapted for engaging with at least a portion of the insertion portion 402 and fixing the relative position of the insertion portion 402 within the receiving portion 404 once the two are engaged.

Figure 14B:
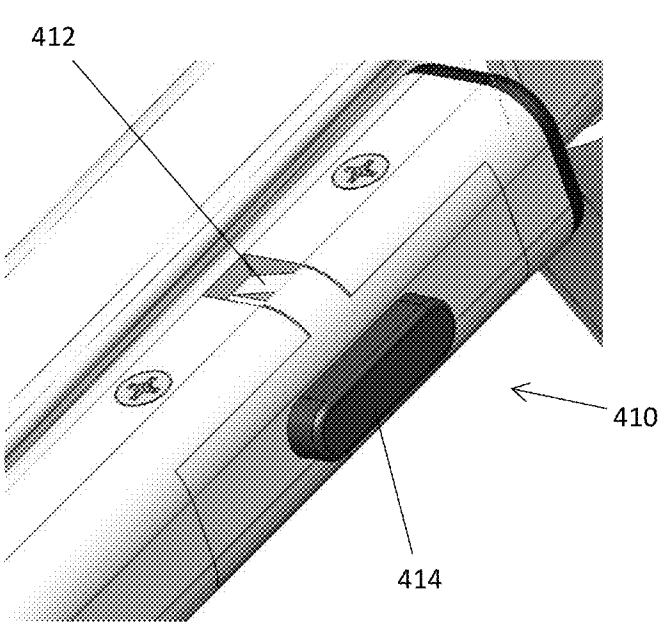
FIGS. 14A and 14B illustrate a latch of the gate of FIG. 13.
Figure 14A:
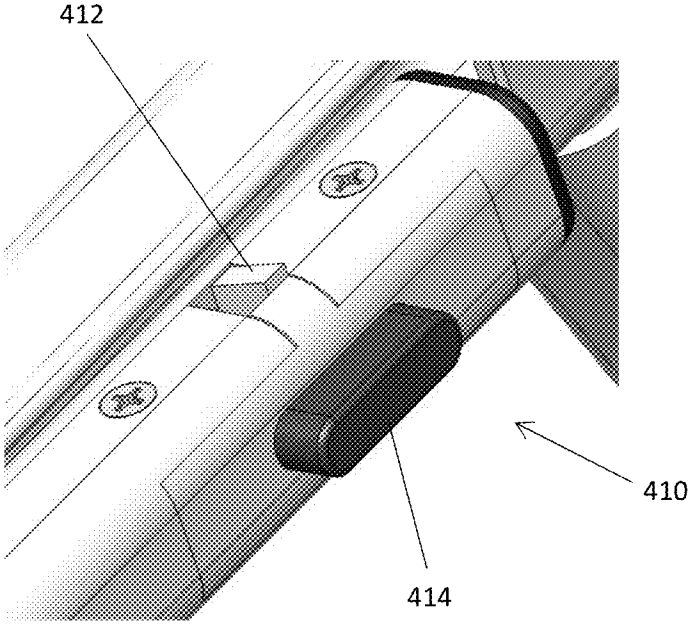

With further reference to FIGS. 14A and 14B, a latch 410 may be provided for fixing the relative position of the first and second gate members 214*a*, 214*b*, once connected. For example, the latch 410 may include one or more retractable extensions 412. The retractable extensions 412 may be adapted to engage the recess 408 of the receiver 406, thereby holding the insertion portion 402 within the receiving portion 404. A latch actuator 414, such as a button or lever, may be provided for retracting the retractable extension 412 to allow for engagement or disengagement of the insertion portion 402 and the receiving portion 404.

In one aspect, the retractable extension 412 may include an inclined surface such that engagement and locking of the insertion portion 402 into the receiving portion 404 to place the gate 214 in the deployed position may occur without actuating the latch actuator 414. However, the inclined surface of the retractable extension 412, once engaged, may prevent removal of the insertion portion 402 from the receiving portion 404 without actuating the latch actuator 414. This may allow for easy deployment of the gate 214 by simply rotating the first and second gate members 214*a*, 214*b* into the deployed position, but requires an additional action, namely actuation of the latch actuator 414, in order to release the gate members 214*a*, 214*b* to be rotated back to the stowed position.

Figure 10D:
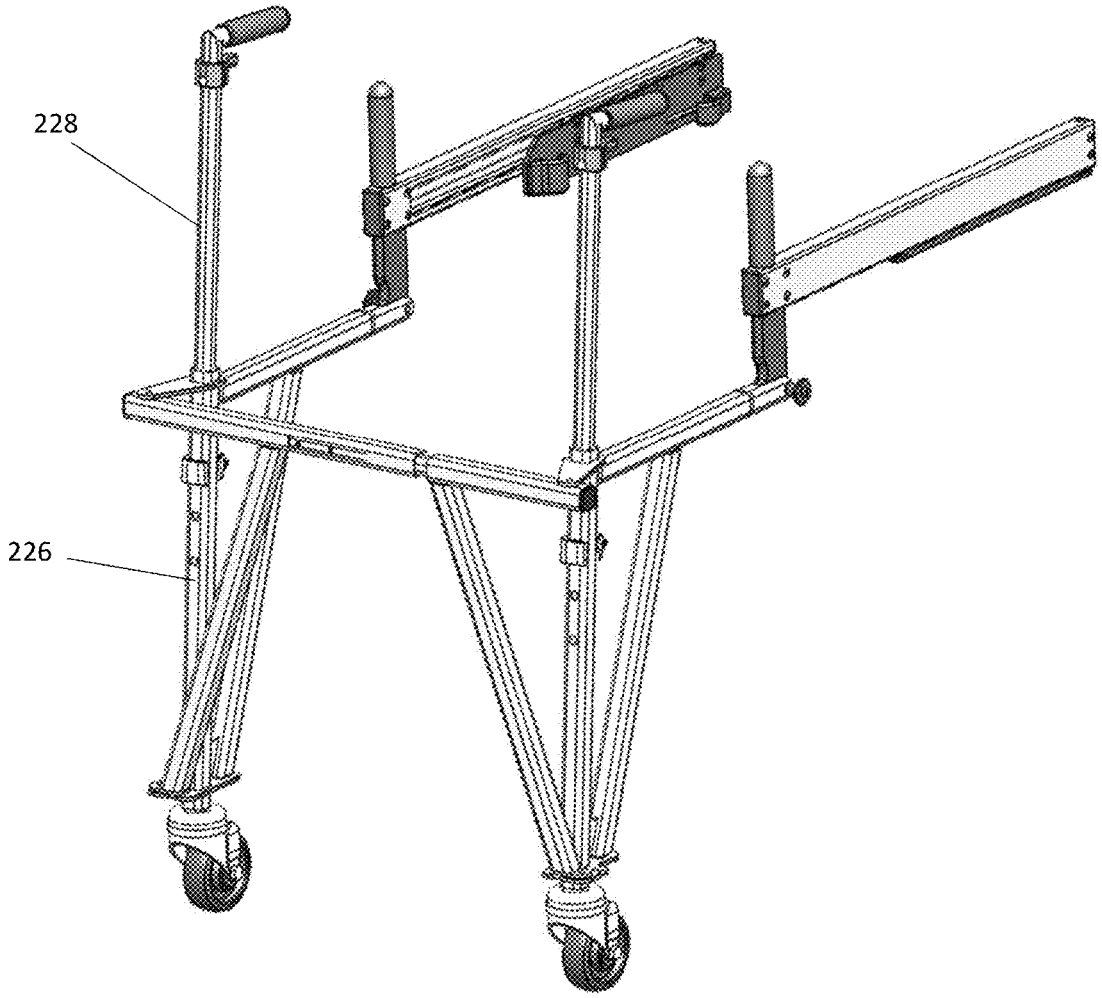
Figure 15:
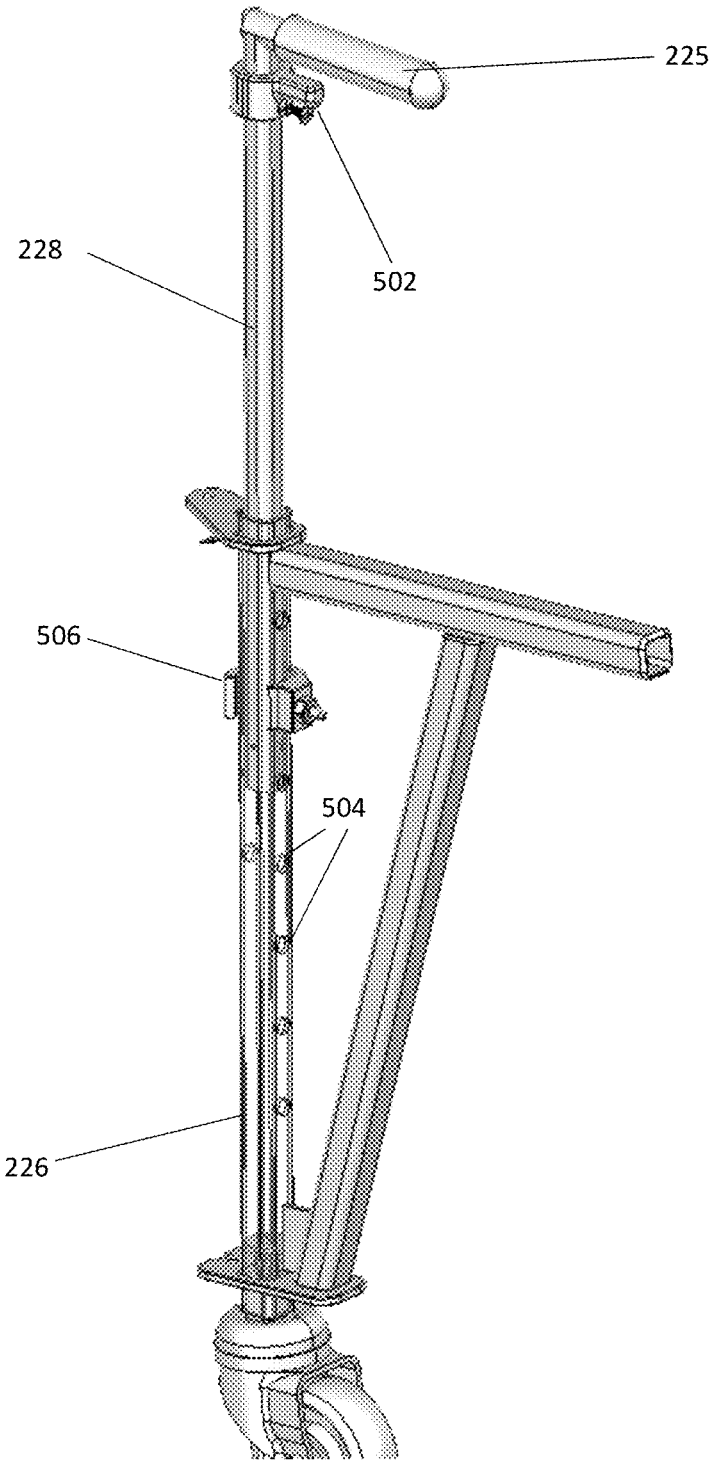
FIG. 15 is a perspective view of an upright rod and handle of the second embodiment with a first member of the upright rod shown as transparent.

Referring back to the transition from FIG. 10C to FIG. 10D, and with further reference to FIG. 15, the walker portion 204 may include a plurality of upright rods 220. The upright rods 220 may each include a handle 225, which may be gripped by the user. For example, the handles 225 may be positioned at or near a top of the upright rods 220. Accordingly, when the upright rods 220 are in an extended position, the handle 225 may provide a grip for the user when the user is standing and using the walker 200.

The upright rods 220 may be telescoping in nature. For example, an upright rod 220 may comprise a first telescoping member 226 and a second telescoping member 228. In the transition from FIG. 10C to 10D, the upright rods 220 have been extended upward, thereby providing an appropriate grip for a user in the standing position.

As shown in FIG. 15, a locking connector 506 may be provided for maintaining a relative position between the first telescoping member 226 (illustrated as transparent) and the second telescoping member 228. A plurality of positional apertures 504 may be provided for locating the locking connector 506 at different heights, thereby allowing for the handle 225 to be deployed to any of a plurality of heights, depending on a height of the user.

Figure 16A:
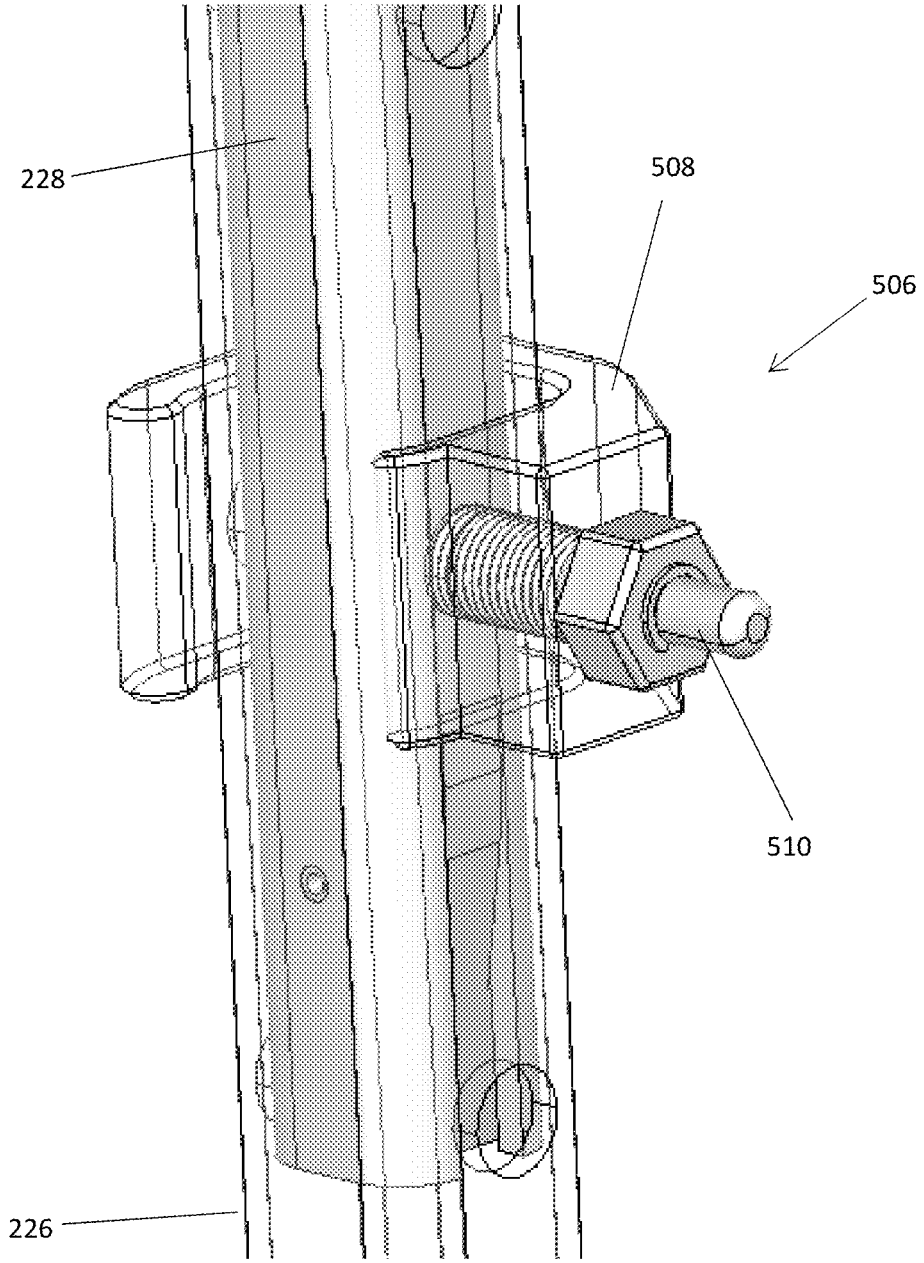
FIG. 16A is a perspective view of a locking connector of the upright rod of FIG. 15 with a portion of the locking connector and the first member of the upright rod shown as transparent.

The locking connector 506 may include a biased member, such as a spring pin 510, as illustrated in FIG. 16A. Accordingly, once the handle 225 is raised to a deployed position, the locking connector 506 may engage both the first and second telescoping members 226, 228 (such as via an aperture in both telescoping members), maintaining the handle 225 in a fixed position for use of the walker 200. In one aspect, the spring pin 510 may be held in position by a connector housing 508. The connector housing 508 may be adapted to clamp or grip the first telescoping member 226 (illustrated as transparent in FIG. 16A).

Figure 16B:
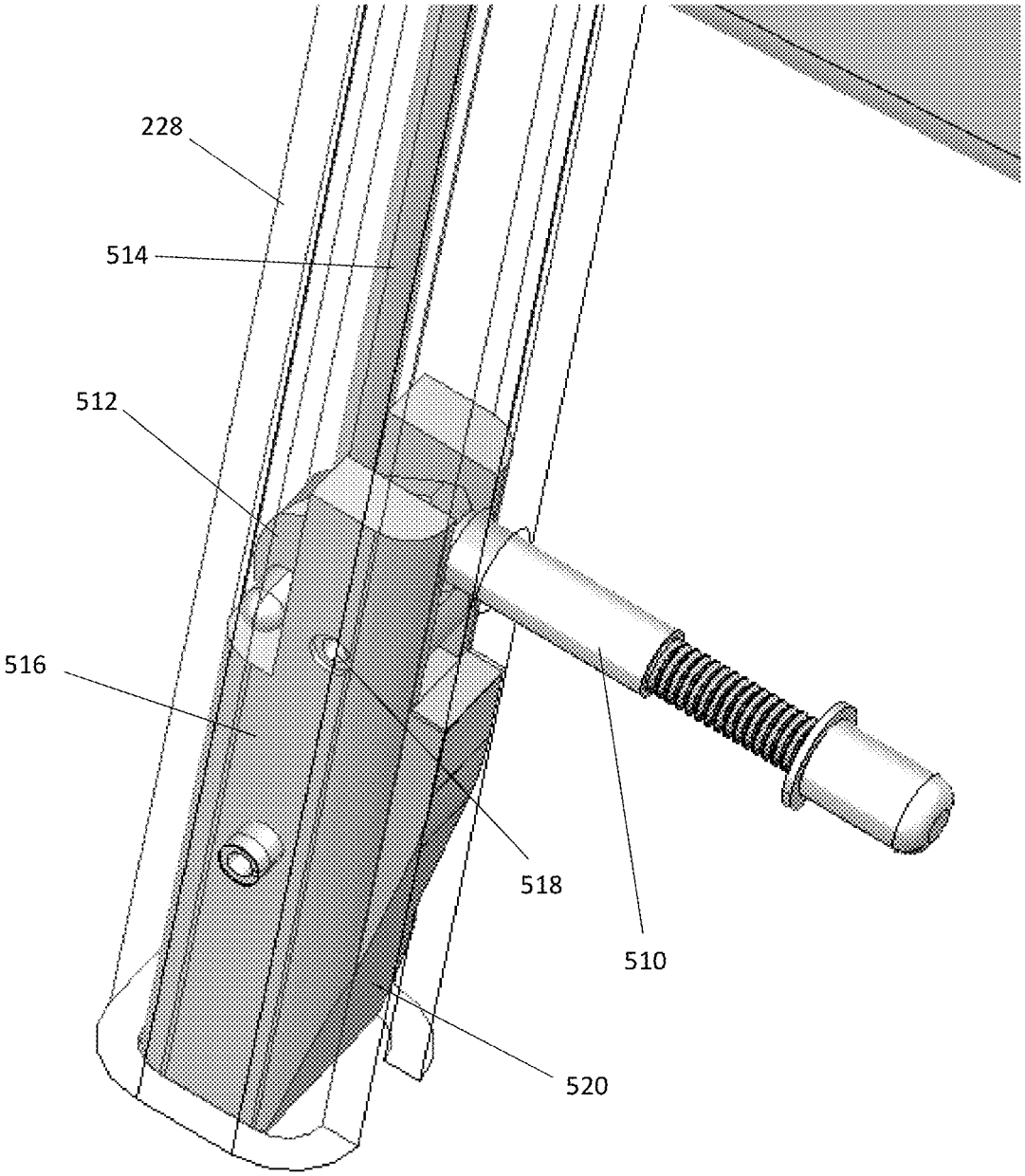
FIG. 16B is a perspective view of a releasing member of the upright rod of FIG. 15 with the first member of the upright rod removed and with a second member of the upright rod shown as transparent.

Turning to FIG. 16B, the second telescoping member 228 (illustrated as transparent in FIG. 16B) may include a releasing member 512 adapted to disengage the spring pin 510 from the second telescoping member, thereby allowing for retraction of the handle 225 to a lowered position. The releasing member 512 may comprise a hinged member, a rotating block, a trigger, or a cam. As shown, the releasing member 512 may be pivotable about a pivot point 518 in a base block 516, which may be positioned within the second telescoping member. Rotation of the releasing member 512 about the pivot point 518 may cause the releasing member to push the spring pin 510 out of an aperture in the second telescoping member, thereby releasing the second telescoping member 228 to move relative to the first telescoping member.

In one aspect, the base block 516 may include an incline 520. The incline 520 may be oriented to face a direction of the spring pin 510, such that upon insertion of the second telescoping member into the first telescoping member, the incline 520 may bias the spring pin outward, thereby facilitating insertion of the second telescoping member 228 to the point at which the spring pin 510 may engage the aperture in the second telescoping member.

Figure 17:
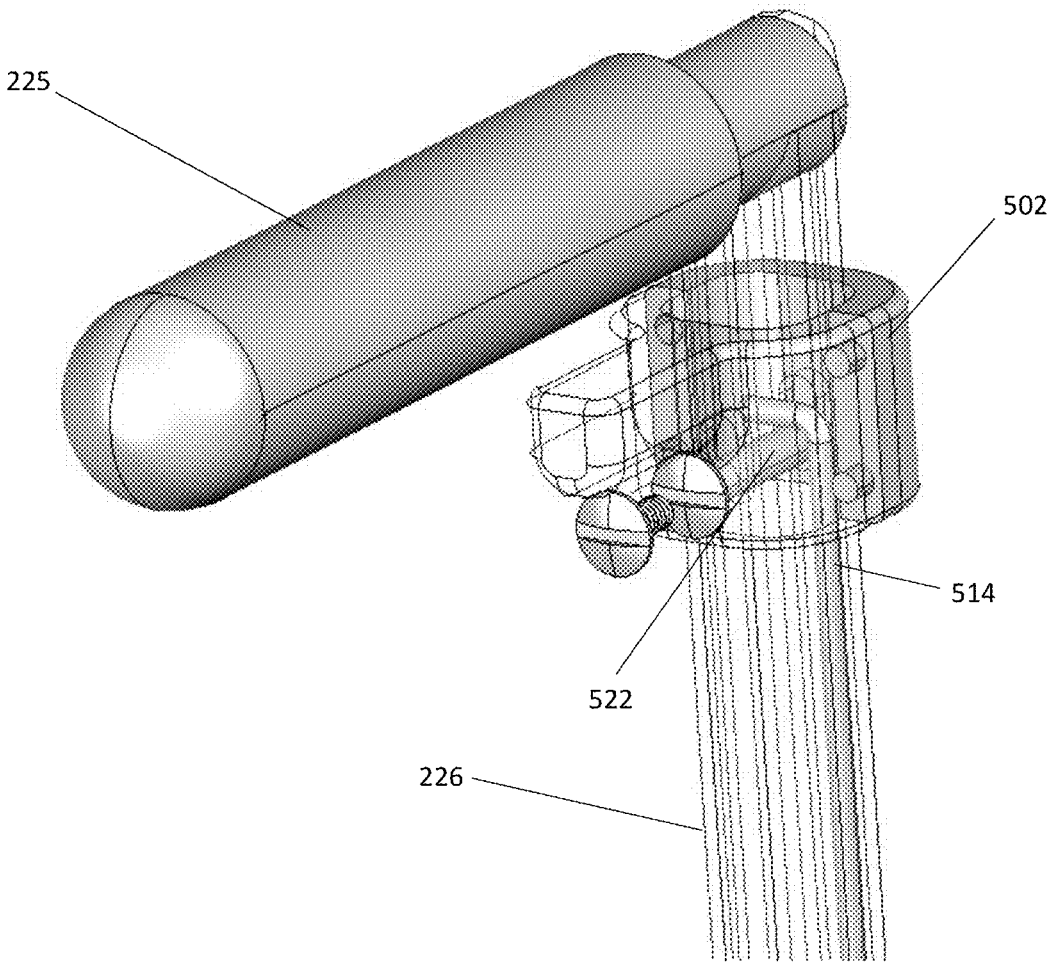
FIG. 17 is a perspective view of an actuator of the upright rod of FIG. 15 with a portion of the actuator and the second member of the upright rod shown as transparent.

Actuation of the releasing member 512 may be accomplished by way of manipulation of a rod 514 that may be attached to the releasing member 512. With reference to FIG. 17, an upper portion of the second telescoping member 226 (illustrated as transparent) near the handle 225 is shown. The releasing rod 514 may be connected to an actuator 502 (illustrated as partially transparent) which may be adjacent the handle. The proximity of the actuator 502 to the handle 225 may be such that the user may actuate the actuator 502 with the same hand that is gripping the handle 225.

Actuation of the actuator 502 may cause the release of the locking connector, thereby allowing for movement of the upright rod between the extended position and the retracted position. Specifically, pulling the actuator 502, much like a trigger, may raise the rod 514, thereby causing the releasing member 512 to pivot and release the spring pin 510. This is because the rod 514 may be fixed to the actuator, such as by an anchor 522 (e.g. a screw, bolt, or other fastener), and raising the actuator causes raising of the rod 514. Accordingly, the upright rod 220 (and therefore the handle 225) may remain locked in the extended position for use when the user is standing, but the user may quickly and easily cause the upright rod 220 (and therefore the handle 225) to move from the extended position to the retracted position for storage simply by actuating the actuator 502.

Figure 18A:
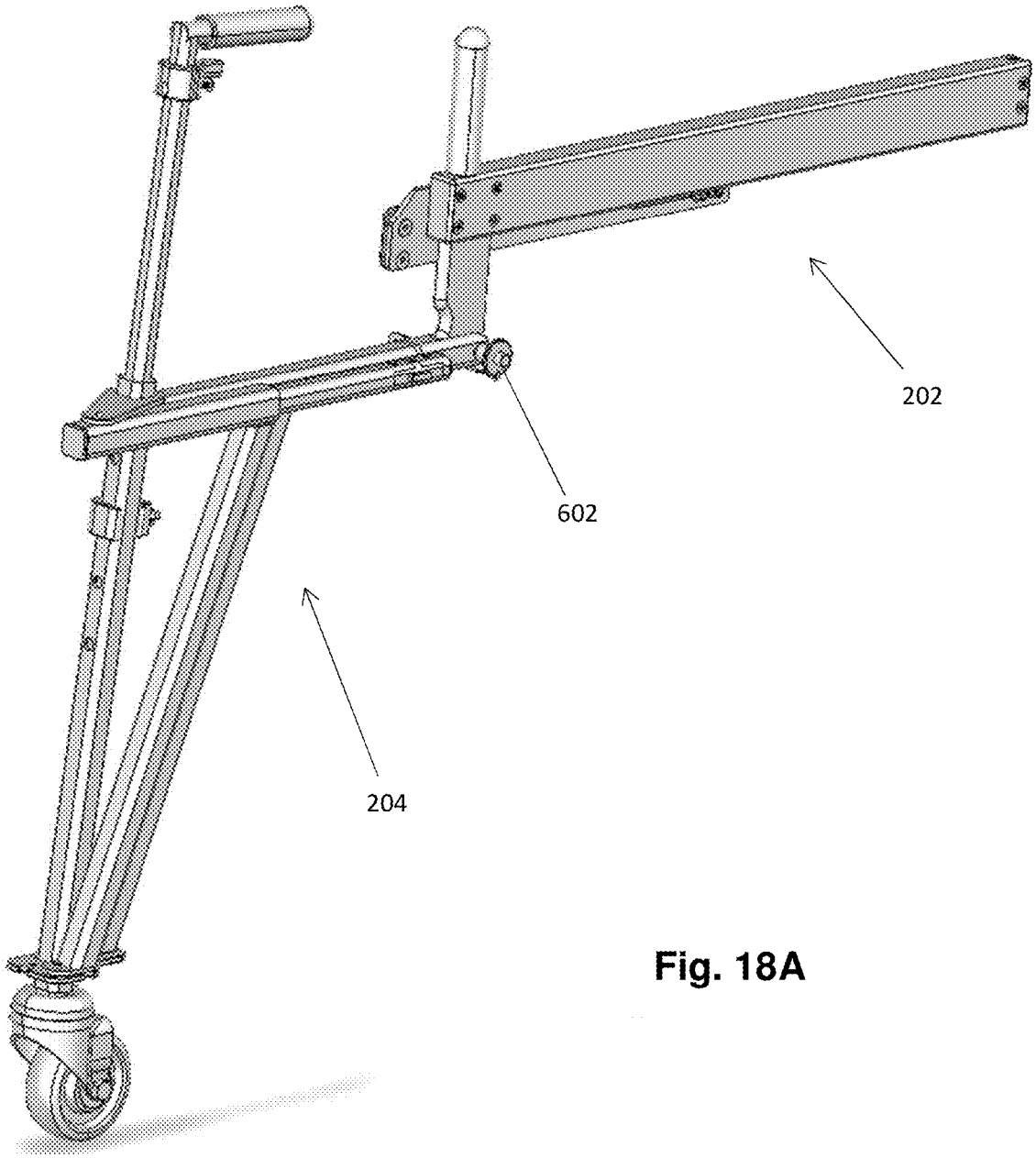
FIGS. 18A-18C illustrate a releasable connector between the extension portion and the walker portion of the second embodiment.
Figure 18B:
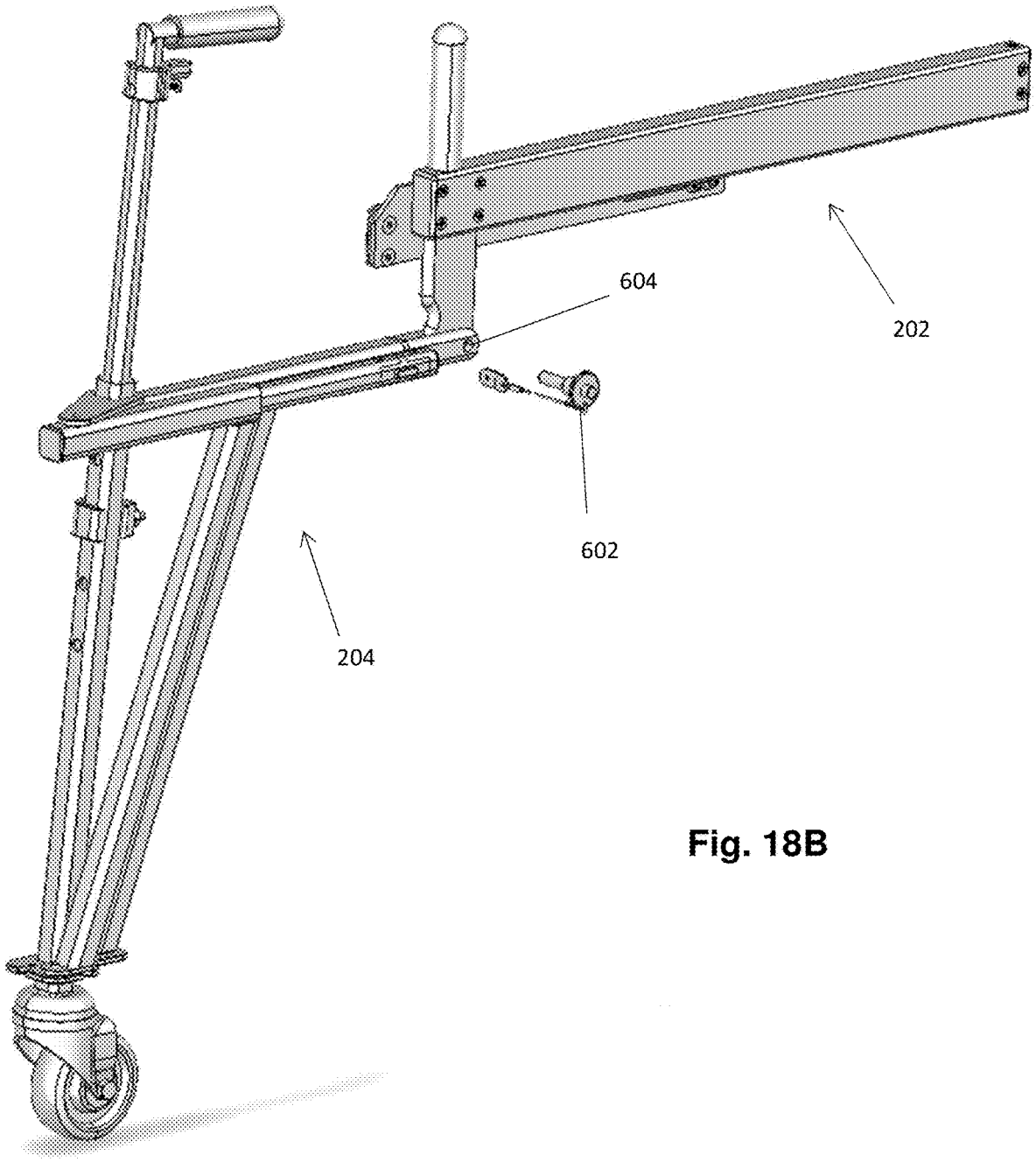
Figure 18C:
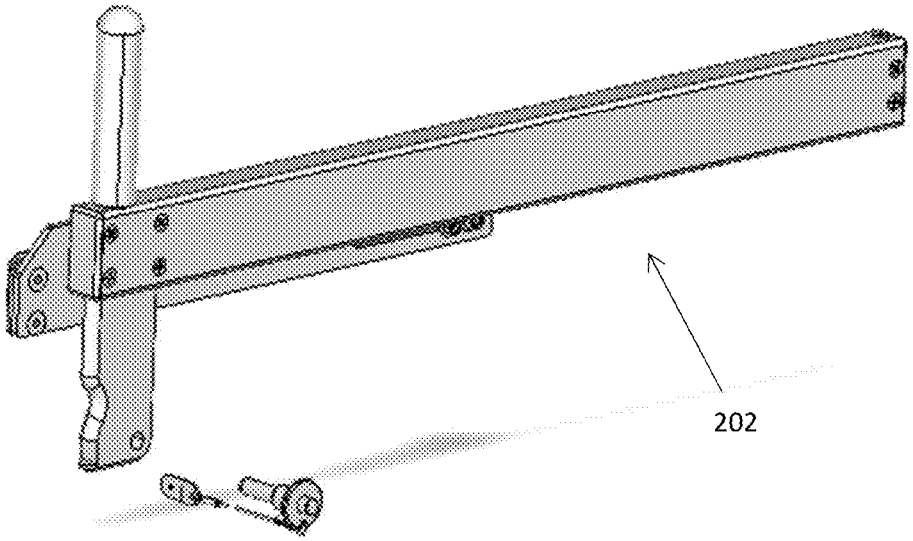

Turning to FIGS. 18A-18C, the walker 200 may include a releasable connector 602 that connects the extension portion 202 to the walker portion 204. The releasable connector 602 may be a locking pin or other removable connector, or may comprise a quick release connector, coupling, or other fitting. In one example, the releasable connector 602 comprises a locking pin that may pass through an aperture 604 in both the extension portion 2020 and the walker portion 204, wherein the locking pin is the only element connecting the two portions. Accordingly, when the locking pin is removed, as illustrated in FIG. 18B, the walker portion 204 may be removed, leaving only the extension portion 202, as shown in FIG. 18C. This may be helpful, as the extension portion 202 may remain attached to a wheelchair, while the walker portion 204 may be easily removed for storage when not needed. Such an arrangement allows for quick and easy reattachment of the walker portion 204 without needing to adjust and attach the clamp assembly 240 to the wheelchair every time the walker 200 is to be used.

While the invention has been described with reference to specific examples, it will be understood that numerous variations, modifications and additional embodiments are possible, and all such variations, modifications, and embodiments are to be regarded as being within the spirit and scope of the invention. Also, the drawings, while illustrating the inventive concepts, are not to scale, and should not be limited to any particular sizes or dimensions. Accordingly, it is intended that the present disclosure not be limited to the described embodiments, but that it has the full scope defined by the language of the following claims, and equivalents thereof.

The invention claimed is:

1. A device adapted for connection to a wheelchair comprising:

a frame comprising a first lateral frame member and a second lateral frame member, each of the first lateral frame member and the second lateral frame member comprising an extension portion and a walker portion;

wherein, when the frame is connected to the wheelchair, each extension portion of the frame is elongated in a direction from an anterior position to a posterior position with respect to the wheelchair, and each extension portion comprises a clamp assembly adapted for releasably attaching to the wheelchair, each of said clamp assemblies adapted to slidably move with respect to a remainder of the frame such that the remainder of the frame may be moved between the anterior position and the posterior position;

wherein the frame comprises a gate, said gate being pivotable between a deployed position in which the gate spans between and connects the first lateral frame member to the second lateral frame member, and a stowed position in which the gate does not connect the first lateral frame member to the second lateral frame member; and wherein the walker portion comprises a handle attached to a telescoping upright rod, said handle adapted for movement between a retracted position and an extended position and adapted for gripping by a hand of a user of the wheelchair.

2. The device of claim 1, wherein the gate is parallel to the direction from the anterior position to the posterior position in the stowed position.

3. The device of claim 1, wherein the gate in the deployed position is adapted to connect the first lateral frame member to the second lateral frame member at a plurality of different widths therebetween.

4. The device of claim 1, wherein the gate comprises a first gate member being part of the first lateral frame member and a second gate member being part of the second lateral frame member.

5. The device of claim 4, wherein each of the first gate member and the second gate member is parallel to the direction from the anterior position to the posterior position in the stowed position, and wherein the first gate member connects to the second gate member in the deployed position.

6. The device of claim 4, further comprising a latch adapted to connect the first gate member to the second gate member.

7. The device of claim 4, wherein the first gate member includes a receiver for receiving an insertion portion of the second gate member.

8. The device of claim 1, wherein the gate is perpendicular to the direction from the anterior position to the posterior position in the deployed position.

9. The device of claim 1, wherein at least one of the extension portions comprises a grip adapted for a user of the wheelchair to grasp and move the remainder of the frame from the posterior position to the anterior position.

10. The device of claim 1, wherein the clamp assembly includes at least one clamp adjustably mounted to a clamp mount, said adjustably mounted clamp adapted to engage wheelchairs of different sizes.

11. The device of claim 1, wherein the extension portion comprises an extension rod with respect to which the clamp assembly is adapted to slide.

12. The device of claim 1, wherein the gate includes at least one releasable lock adapted to fix the gate in each of the stowed position and the deployed position.

13. The device of claim 1, further including at least one locking connector, said locking connector adapted to alternately fix the telescoping upright rod in each of the retracted position and the extended position; and further comprising an actuator adapted to release the locking connector, thereby allowing for movement of the telescoping upright rod between the extended position and the retracted position, said actuator adjacent the handle and adapted for actuation by the user while the user is gripping the handle.

14. The device of claim 13, wherein the locking connector comprises a spring pin, and wherein the device further includes a releasing member adapted for engaging the spring pin, said releasing member connected to the actuator by a retractable rod.

15. The device of claim 14, wherein the releasing member comprises a cam, and wherein the retractable rod is adapted to cause the cam to rotate about an axis, thereby retracting the spring pin and releasing the telescoping upright rod to move between the extended position and the retracted position.

16. The device of claim 14, wherein the retractable rod is connected to the actuator by an anchor.

17. The device of claim 1, further comprising a releasable connector adapted to releasably connect the extension portion from the walker portion.

18. The device of claim 17, wherein the releasable connector comprises a locking pin that is adapted to lock in place within an aperture that passes through a portion of each of the extension portion and the walker portion of the frame.

19. A device adapted for connection to a wheelchair comprising:

a frame comprising a first lateral frame member and a second lateral frame member, each of the first lateral frame member and the second lateral frame member comprising an extension portion and a walker portion; and a releasable connector adapted to releasably connect the extension portion to the walker portion;

wherein, when the frame is connected to the wheelchair, each extension portion of the frame is elongated in a direction from an anterior position to a posterior position with respect to the wheelchair, and each extension portion comprises a clamp assembly adapted for releasably attaching to the wheelchair, each of said clamp assemblies adapted to slidably move with respect to a remainder of the frame such that the remainder of the frame may be moved between the anterior position and the posterior position; and wherein the frame comprises a gate, said gate being pivotable between a deployed position in which the gate spans between and connects the first lateral frame member to the second lateral frame member, and a stowed position in which the gate does not connect the first lateral frame member to the second lateral frame member.

20. The device of claim 19, wherein the releasable connector comprises a locking pin that is adapted to lock in place within an aperture that passes through a portion of each of the extension portion and the walker portion of the frame.

* * * * *